US010099887B2

(12) United States Patent
Kling

(10) Patent No.: US 10,099,887 B2
(45) Date of Patent: Oct. 16, 2018

(54) FOLDING METHODS, STRUCTURES AND APPARATUSES

(71) Applicant: Daniel H. Kling, New Hope, PA (US)

(72) Inventor: Daniel H. Kling, New Hope, PA (US)

(73) Assignee: FOLDSTAR, INC., Holmdel, NJ (US)

( * ) Notice: Subject to any disclaimer, the term of this patent is extended or adjusted under 35 U.S.C. 154(b) by 842 days.

(21) Appl. No.: 14/064,927

(22) Filed: Oct. 28, 2013

(65) Prior Publication Data

US 2014/0135195 A1 May 15, 2014

Related U.S. Application Data

(63) Continuation of application No. 12/233,524, filed on Sep. 18, 2008, which is a continuation of application No. 11/440,263, filed on May 23, 2006.

(60) Provisional application No. 60/683,689, filed on May 23, 2005.

(51) Int. Cl.
*B65H 45/12* (2006.01)
*B31D 3/00* (2017.01)

(52) U.S. Cl.
CPC ..... *B65H 45/12* (2013.01); *B31D 3/002* (2013.01)

(58) Field of Classification Search
CPC ..... B65H 45/12; B31D 3/002
USPC ..... 493/451
See application file for complete search history.

(56) References Cited

U.S. PATENT DOCUMENTS 2,901,951 A * 9/1959 Hochfeld ..... B21D 5/16 210/493.5
4,027,517 A * 6/1977 Bodnar ..... B21D 13/08 72/177
4,480,456 A * 11/1984 Iwase ..... B23D 25/04 72/185
4,753,096 A * 6/1988 Wallis ..... B21D 13/04 72/196
5,080,326 A * 1/1992 Price ..... C21D 8/1294 148/104
5,947,885 A * 9/1999 Paterson ..... A63H 33/16 493/448
6,183,879 B1 * 2/2001 Deeley ..... B21D 13/04 29/421.1
6,197,129 B1 * 3/2001 Zhu ..... B21C 23/001 148/400
6,221,299 B1 * 4/2001 Mirtsch ..... A61B 17/80 264/285
6,497,130 B2 * 12/2002 Nilsson ..... B21D 13/04 428/603
6,618,049 B1 * 9/2003 Hansen ..... G06T 15/20 345/423
6,664,960 B2 * 12/2003 Goel ..... G06T 17/20 345/423
6,850,235 B2 * 2/2005 Levanon ..... G06F 3/14 345/423

(Continued)

*Primary Examiner* — Sameh Tawfik
(74) *Attorney, Agent, or Firm* — Fox Rothschild LLP

(57) ABSTRACT

A method for providing folded sheet structures comprising selecting an aspect surface, applying a shaping function to said aspect surface to yield a shaped surface, applying a floating point method to obtain a floated surface, and calculating a corresponding fold pattern on a unfolded sheet. The floating point method can be applied reiteratively to calculate the corresponding fold pattern. Machines for folding multifold structures, laminate structures, and micro- and nano-structures are disclosed.

9 Claims, 50 Drawing Sheets

(56) References Cited

U.S. PATENT DOCUMENTS

| | | | | |
|---|---|---|---|---|
| 6,935,997 | B2 * | 8/2005 | Kling | G06T 17/20 493/356 |
| 9,005,096 | B2 * | 4/2015 | Kling | B31D 3/002 493/356 |
| 9,165,403 | B2 * | 10/2015 | Sun | G06T 17/005 |
| 2002/0094926 | A1 * | 7/2002 | Kling | G06T 17/20 493/356 |
| 2003/0014947 | A1 * | 1/2003 | Deevi | B32B 15/04 53/461 |

* cited by examiner

Industries of Application

1. Packaging
2. Housing
3. Civil Engineering
4. Automotive
5. Aerospace
6. Filters
7. Shock/Sound Absorption
8. Decorative Applications
9. Other

Fig. 9

Sheet Materials of Application

- Paper Materials
- Aluminum and Steel Sheet
- Composite Cloths
- Nano-Materials
- Polymer Sheet Materials
- Ceramic Filled Papers
- Any Material that Folds

Fig. 10

Structures of Application

- Panel Core Materials
  - Lightweight, High Performance, Cost Effective
- Energy and Shock Absorption
- Acoustical Properties
- Filters, Catalytic Converters, others
- Flexible Tube and Flexible Sheet Products
- New Multi-laminate Bulk Materials

⋮

Fig. 11

Useful Math

- Pattern Design Algorithms
  - Unlimited Variety
  - Software
  - Patents Pending
- Manufacturing Process
  - Multiple Continuous Production Processes
  - Multiple Discrete Parts Processes
  - Software & Theoretical Modeling of Material Flow
  - Patents Pending

Fig. 25

Direct and Versatile Software

Curve Data Correspondences

Generation and
Editing Tools

Curve Data

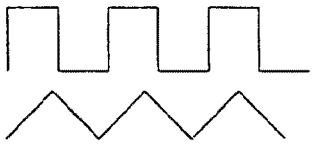

Multiple Algorithms

And Data Options

3-D DPF

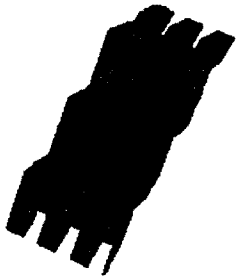

Patterned
Geometry
Design

Structural
Analysis

Mesh for
FEA

Roller
Design
Software for
continuous
process

Further
Operations
for custom
fitting
structures

Tessellation

Parameterization (a,b,c,A,B)

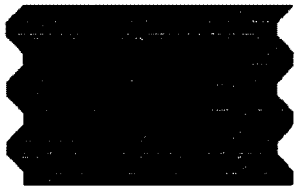

, θ

Experimental
FEA

Analytical

Optimization

Assembly Blueprint

Articulating Die
Design

Discrete Parts
Folding Process

Material Flow for
additional processes

Fig. 32

Discrete Parts Manufacturing Concept

Folding Occurs only at specific locations in sheet material

Facets are rigid and do not twist during the folding process

Folding Occurs Simultaneously on each Unit of Repetition

Manufactured galvanized steel

Copper

Wire mesh

Epoxy-Fiberglass Composite

Continuous Manufacturing Concept
(Kling 1990)

A: Pre-gather with the correct contraction ratio,

B: Feed into the Patterned Rollers

C: Produce Folded Tessellation

Useful Math

The Details are very subtle, for instance changing the pattern on the rollers by 90 degrees would not work.

Machine is Simple, adapts and performs well to multiple tested patterns

Models Optimizing Performance involve differential geometry, planar combinatorics, and computer simulation

Fig. 42

Some Commercial Applications

- Composite Bridge Decks
- Pre-stressed steel DPF's in office floors
- Nano-structures
- Multi-layer bulk materials
- Non-invasive biomedical implants
- Aerospace doubly-curved panels
- Packaging materials
- Transportation Industry
- Building Materials
    - ⋮

Fig. 43

Recent Developments

- New Generation of Designing Algorithms
- New Continuous Machine Processes
- New Discrete Parts Process
- Nano Patents Pending
- Material Flow Software

Fig. 44

Multi-laminate Actuating Method

1. Laminate Preparation:

- Glue Applied on flat sheet in tessellation bonding area pattern
- Expanding foams, vapor or steam releasing agents applied between glue
- (Optional) Contracting Compounds Applied to Fold Valleys [Nano Self Assembly Technique]

2. Lamination

3. Activation

Yields: Multi-Laminate DPF Block

Multi-laminate Expanding Method

Paper Products

- Construction and Housing Materials
  Particle Board, Plywood, Ceiling Tile…
- Bulk Materials for Cutting and Assembly
  Packaging Inserts, Furniture, Cardboard
- Insulated Food Containers
- Absorbent Materials
- Dynamic Structures
- Many Others

Fig. 48

FOLDING METHODS, STRUCTURES AND APPARATUSES

CROSS-REFERENCE TO RELATED APPLICATIONS

This application is a continuation of U.S. application Ser. No. 12/233,524, filed Sep. 18, 2008 which claims the benefit under 35 U.S.C. § 120 and is a continuation of U.S. patent application Ser. No. 11/440,263, which claims the benefit under 35 U.S.C. § 119(e) of U.S. patent application Ser. No. 60/683,689 filed May 23, 2005. The contents of these prior applications are herein incorporated by reference in their entirety.

FIELD OF THE INVENTION

The present invention relates to methods for preparing folding structures More particularly, the present invention relates to applying a shaping function to an aspect surface and applying a floating point method to obtain a floated surface. The folded structures of the present invention comprise nanostructures prepared from self assembly techniques.

BACKGROUND OF THE INVENTION

Folded structures have many advantages over structures produced by other means such as casting, stamping or assembling due to cost of manufacture and versatility as adapted to sheet materials. Among methods for designing folding patterns include simple folding patterns containing planar regions and no internal vertices, for example box pattern with six squares forming a "t"; Origami bases, for example a square origami sheet with multiple pointed legs as the intermediary step for making origami animals and figures; two-dimensional flattened patterns where the sheet is folded back into its original plane, forming multiple layers with various geometries, but no three-dimensional structures are made; and factorable three-dimensional patterns surfaces that reduce into row and column cross sections as described by U.S. Pat. No. 6,935,997 to Kling (hereinafter the "Kling patent"), which is herein incorporated by reference. Material flow and mathematical models in doubly-periodic folding (DPF) structures were described in detail by the Kling patent.

The methods of the Kling patent may be restrictive and another problem with designing doubly periodic folded (DPF) structures, or other folded structures with substantially many fold vertices on the interior not on the boundary or by cut-outs is very difficult due to pleat-angle conditions and other constraints. In addition to the zero-curvature condition enabling foldability, structures are desired having periodicity features, having local facet configuration arrangements, and having overall shapes that are bounded by planar or curved surfaces. Further, designing a curved edge is complicated because its two curved neighboring faces will be curved, it will have a compound curve formed by the intersection of the two faces, and its geodesic curvature from both sides must sum to zero.

Given the above, applicant has found an Aspect Shaping Floating (ASF) method for design and preparation of folded structures.

SUMMARY OF THE INVENTION

A method for providing folded sheet structures comprising selecting an aspect surface, applying a shaping function to said aspect surface to yield a shaped surface, applying a floating point method to obtain a floated surface, and calculating a corresponding fold pattern on a unfolded sheet. The floating point method can be applied reiteratively to calculate the corresponding fold pattern.

I. Method for Designing Folded Structures

A. Problem: Designing doubly periodic folded (DPF) structures, or other folded structures with substantially many fold vertices on the interior (not on the boundary or by cutouts) is very difficult due to pleat-angle conditions and other constraints. In addition to the zero-curvature condition enabling foldability, structures are desired having periodicity features, having local facet configuration arrangements, and having overall shapes that are bounded by planar or curved surfaces.

B. Solution:

1. A known DPF, known foldable structure, or known non-foldable structure is chosen with some periodicity, local configuration arrangement and overall shape. Additional vertices and edges may be added as in subdivision.

2. A warping function is used to relocate the vertices into a more desirable configuration. This warping function may be easily generated, by choosing a function that sends the original overall shape to the desired overall shape, and then applying the function to the vertices of the surface. Note that nearly always the resulting surface will not be foldable.

3. A surface evolving algorithm is applied to the warped surface. The algorithm adjusts the vertices to approximate a zero-curvature surface. The evolving algorithm is applied reiteratively as needed to produce the desired accuracy. Constraints preserving specific features of the original surface may be added, including facet-to facet tie areas in the structure. This yields a foldable structure with desired periodicity, local configuration and overall shape. It is also possible to add conditions yielding new features.

4. From this 3-dimensional structure, the corresponding fold pattern on an unfolded sheet may then be easily back-calculated.

C. Applications:

1. Conventional DPFs having planar or cylindrical overall structures, such as those found in U.S. patent application Ser. No. 09/952,057 filed Sep. 14, 2001 by Kling ("Kling"), which is incorporated herein by reference, can readily be designed and worked. In fact, this new method can generate all of the patterns of the previous method and many others, and can be incorporated into software much more flexible and immediately convenient than the prior method's software.

2. Designing irregular or custom folded structures, such as in a car door or product display case with specific attach points or shape constraints.

3. Designing laminated panels or core designs for precisely curved airplane wings, etc.

4. Rapid prototyping and manufacture of nano components (in conjunction with self-assembly and wetting procedures). Also for larger components.

II. Multi-laminate DPF Materials: Several Layers of Folded Sheet or Tube can be Laminated Together to Produce New Products with Many Application A. Sheet Sequencing 1. Multiple layers of the same DPF, alternately staggered or in minor image as desired for bonding areas.

2. Alternating sequence of one DPF and flat sheet or conventionally fluted corrugation. [0023]

3. Alternating sequence of DPF and same DPF rotated 90 degrees.

4. Alternating sequence of one DPF and flat sheet or conventionally fluted corrugation with various rotations.

5. Bundled DPF tubes.

6. As above with threads or wires or linear elements.

7. Others.

B. Bonding Contacts

1. Face to face: facets are designed to align in parallel, enabling bonding areas.

2. Edge to edge: Fold creases designed to align in parallel for edge to edge bonding 3. Edge to face.

4. Other.

C. Product Types

1. New bulk materials with customize cellular structure. These materials may have independently tailored physical properties in the x, y, z directions. The bulk materials may undergo additional machining or manufacturing processes.

2. Sheet materials. Multi-laminate sheets, with relatively few layers in comparison to the width or length of the sheets, can serve numerous value for sheet materials. These may be lightweight, rigid, flexible, sound absorbing, sponge-like, resilient, energy absorbing, and other qualities.

3. Poles, linear elements, rods. Bundled tubes can used to produce lightweight cellular poles with unusual strengths.

D. Applications

Unbreakable Styrofoam

Lightweight machinable materials (Try polymers, paper fiber, ceramic, metals)

Particle board substitute

Padding blankets

Shock or impact absorbers

Flexible insulative paper sheet (may be like cloth or foam rubber but from paper)

Plastic lumber

Recycled paper lumber

Filters

Cups

Other

III. Hardening Mixes in Folded Materials

A. Commonly ceramic, plasters, and polymers are put into sheet material to be applied in small pieces or folded in a corrugation-type (parallel linear folds) pattern.

B. Novelty: Our materials have fold lines occurring in multiple directions, with crease lines forming networks yielding faceted three-dimensional structures. Furthermore the structures are often periodic in two independent directions.

C. Advantages: These structures may have all kinds of properties not found in conventional corrugation. Folding is simple and applying hardening mixes to a sheet, folding it, and then curing it is a an efficient way to make the complex structures. In some cases the sheet may be folded first, the hardening mix then applied. Also the impregnated folded sheet may be further manipulated before curing. If faces or multi-laminates are being manufactured, the impregnated pieces may be assembled before curing, to produce a monolithic assembly post cure.

D. Applications: Cups, truck bodies, filters, catalytic converters, building materials, doubly-curved Formica counter-tops or sinks, lay-up webs for composite molding, many others.

IV. Continuous Folding Machine

A. Rolled sheet material may be fed through a series of operations to continuously produce many of the common DPF structures. First the material is corrugated longitudinally. This can be done by any of many state of the art techniques. The material then feeds through two sets of facing parallel articulating rollers (figure forthcoming). As these rollers oscillate they impart an approximate sign wave into the folded sheet. The sheet thus roughed out is fed through one or more sets of secondary rollers imparting the polygonal DPF pattern.

B. This procedure has many advantages over Kling's prior machine design. The oscillating rollers may have flat or grooved rubber roller backings, and the entire assembly man oscillate laterally in synchronization, enabling controlled positioning of the crease on both the sheet geometry and the position in three-space. The procedure is expected to be able to handle a more diverse range of sheet materials. Also for producing sine cores and similar materials, one machine could produce multiple scales and varieties by simply changing settings.

V. Micro- and Nano-Multifold Methods and Structures

A. Self-assembly techniques for micro- and nano-structures have been developed by, for example, George M. Whitesides (Fabrication of Micrometer-Scale Patterned Polyhedra by Self-Assembly, Advanced Materials (2002), vol. 14, no. 3, February 5, 235-238, which is incorporated herein by reference, and described in many other publications. Also, Whitesides has an extensive website of folded micro and nano scale materials. The present invention is especially valuable because most of the techniques for constructing small objects have been 2-dimensional procedures such as lithography and etching used in making computer chips by layers. Folding provides a means to get up off the plane. The basic technique is to etch the folding panels, deposit a solder along the fold lines, remove the unfolded part from the substrate, and then heat it so that the solder wants to bead-up by surface tension and pulls the flaps in the process. Surface tension is the dominant force on small scales.

B. The direct applications of the self-assembly techniques to DPFs and other multifold structures has many industrial uses. One, the light board, is to put an array of components such as light transistors, sensors, emitters, on the etched and prepared flat sheet by conventional 2-dimensional processes. The sheet is then folded, positioning the components in a three dimensional array. To be faster, future computer chips may use light instead of electricity because light generates less heat, enabling the circuits to be smaller and denser, and thus the chip is faster.

C. Another application combines the shaping algorithm (referred to in Section I. and below) to manufacture small objects. First, a shape is selected, such as a vessel, worm gear, valve part, or anything needed on the nano scale to be manufactured. A conventional DPF design, or variation, having generally the same overall shape is selected. If needed, a warping function is used to bend the DPF overall shape so it fills out the desired nano shape. The flat pattern is back-calculated, computer soft lithography or other 2D process prints the blank, and the self assembly process causes it to fold. The resulting structure has the correct profile as the desired shape, but is filled with zig-zag looking ribs or fold facets. This is then wet with a polymer or other material, the excess is removed by heat, vacuum, other solvents or mechanically, leaving only the polymer/material in the folds. Finally the resulting article is cured, and the vessel with solid shell is produced.

D. An important specific aspect is designing tie areas in the folded structure. This means the self assembly process will lock at the correct amount of folding.

BRIEF DESCRIPTION OF THE DRAWINGS

FIG. 9 indicates industries of applications of embodiments of the present invention.

FIG. 10 indicates sheet materials of application for embodiments of the present invention.

FIG. 11 indicates structures of application for embodiments of the present invention.

FIG. 25 indicates useful math for embodiments of the present invention.

FIG. 32 indicates a broad material science environment.

FIG. 42 indicates useful math for an embodiment of the present invention.

FIG. 43 indicates some commercial applications for an embodiment of the present invention.

FIG. 44 indicates recent advancements.

FIG. 48 indicates potential uses for embodiment paper products.

DETAILED DESCRIPTION

Fold Pattern Generation Method

Figure 1:
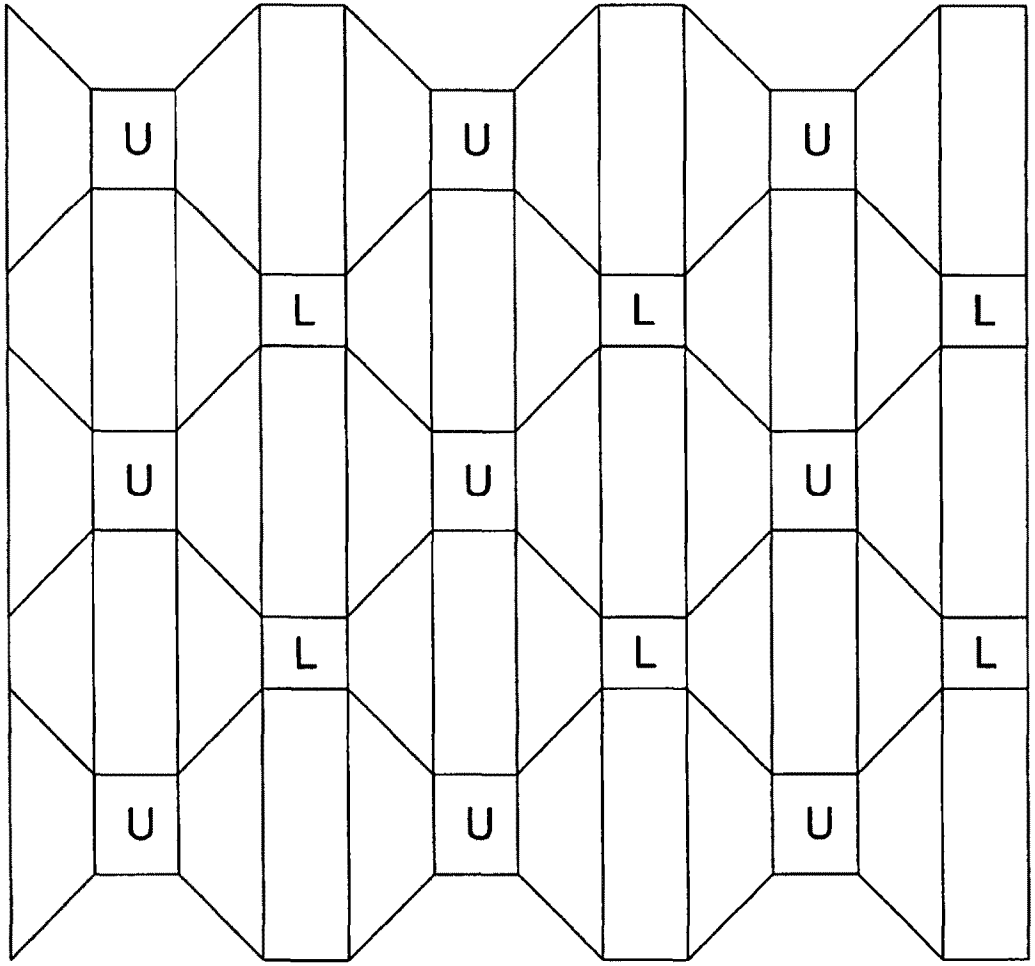
FIG. 1 shows tessalation for a double square wave pattern and similar convex sequence patterns, where "U" indicates upper mounting plates and "L" indicates lower mounting plates.

It is known in the art that an abstract surface folded from a plane region with no in-plane distortion will have zero Gauss curvature. These surfaces are called developable surfaces and are piecewise smooth, with cone angle 360 degrees at each vertex, the geodesic curvature along the edges of two meeting regions will sum to zero, and the smooth regions (to be called faces) will be ruled surfaces of planar cylindrical, conical, or tangent indicatrix type. Limited state of the art methods are available for designing folding patterns.

1. Simple folding patterns: those with planar regions, and no internal vertices, such as the box pattern with six squares forming a "t".

2. Origami bases: Procedures for giving a square origami sheet multiple pointed legs as the intermediary step for making origami animals and figures.

3. Two-dimensional flattened patterns. In these patterns the sheet is folded back into its original plane, forming multiple layers with various geometries, but no three-dimensional structures are made.

4. Factorable three-dimensional patterns: These patterns were in Kling. Multiple methods for designing this particular class of factorable folding patterns were given. This class is limited to surfaces that reduce into row and column cross sections. The locally two-dimensional area information breaks apart into two curves, which have locally one-dimensional information. It is somewhat restrictive to have this reduction in dimension where the entire surface can be generated from two cross sections, as disclosed in the methods of Kling. In particular for this class the column edges of the entire structure are all co-planar up to translation.

What is needed is a method for designing arbitrarily complex patterns with one or more of the following features:

i) Many internal vertices ii) Many cycles of faces iii) Non-linear edges iv) Non-planar faces An internal vertex is a vertex not on the perimeter of the pattern and without slits or cut edges to it.

A cycle of faces is a face-to-face walk that returns to the starting face without re-tracing the same face.

Designing a curved edge is complicated because its two neighboring faces will be curved, it will have a compound curve formed by the intersection of the two faces, and its geodesic curvature from both sides must sum to zero.

The present invention comprises:

1) The General three-step ASF Method of designing folding patterns

2) The Floating Method step

3) Resulting classes of novel structures—perhaps i. Prime periodic ii. Prime semi-periodic iii. Profile-fitting semi-periodic iv. Rotational symmetry with curved facets 4) Some applications of these structures The general method for designing folding patterns is as follows:

An aspect surface is chosen. This surface may be a known foldable surface, may resemble a foldable surface, or may be speculated to generate useful folding configurations. The aspect surface may have a combinatorial pattern that is useful. This may be a convexity pattern, a general periodicity, specific shapes or distributions of polygon faces, or other geometrical components. The surface may have specific features, such as mounting areas for attaching other materials, internal bonding areas for face-to-face, edge-to-face, edge-to-edge, vertex-to-face, etc, or any other geometrical properties. Typically, the designer selects an aspect surface that resembles the desired folding pattern in the relevant features, geometric character, an/or other aspects of the specific application.

A shaping function is applied to the aspect surface to re-proportion the aspect surface in the desired configuration. In some applications, the shaping function may move all the vertices to conform to a new overall shape. In this case, it may be preferred to view the aspect surface as contained in a surrounding solid, select the shaping function so that this solid is conformed to the desired shape, and then apply the shaping function to specifically to the aspect surface. In some applications, the shaping function may move only selected portions of the aspect surface. For example, the designer may be incorporating new features into local portions of the pattern. In some application the shaping function may be omitted. For example, the designer may have implicitly applied a shaping function into his choice of aspect surface, or may not want to adjust the position of the aspect surface. To simplify description, the case when no vertices are moved will be considered as applying the identity shaping function.

After the shaping function has been applied to the aspect surface, yielding the shaped surface, my Floating Method (preferred embodiment given further below) is applied. The Floating Method moves (floats) the vertices of the shaped surface incremental amounts by mathematical relationships so that the resulting surface more closely approximates a foldable surface. Through reiteration, if necessary, a foldable surface can be produced within any limits of precision. Often constraints are imposed during the Floating Method so that the shaped surface maintains selected features. For example, it may be that a facet-to-facet bonding area in the aspect surface is desired in the floated surface, or that a planar face in the aspect surface is desired to be planar in the floated surface. It may be that the shaped surface is tangent to a surface, and the vertices are to be floated to stay on that surface, for, perhaps, forming a curved laminate panel. Periodicity may be imposed as a constraint. Sometimes constraints are added to the Floating Process that were not present in the shaped surface. To give a rough sense for triangulated surfaces, each vertex has three dimensions of position and one condition for zero-curvature, the condition that its cone angle add to 360. Neglecting the effects on the boundary of the tessellation and other features, there thus are approximately two dimensions of constraints available per vertex to be imposed during the Floating Method.

As above, through iteration if necessary, the floated surface is obtained and may be foldable from a plane region to within any required precision and with desired constraints and features. The region on the plane that folds into the floated surface is easily calculated. This plane region, preferably with marked or etched fold locations and fold convexity information, may then be used as a pattern to yield the floated surface. This plane region including desired vertex, fold crease location, boundary information, convexity information and other features of the floated surface is called the plane figure.

Generally, the steps may be described as follows:

1. Selecting an aspect surface
2. Applying a shaping function
3. Applying the Floating Method
   i. optionally, reiteratively
   ii. optionally, with constraints
4. Back calculating the plane figure.

comprise my Aspect-Shaping-Floating Method (ASF Method) for designing these desirable folding patterns. Variations are also included in the ASF Method, such as incorporating constraints into the shaping function or applying the shaping function between iterations of the Floating Method.

EXAMPLES

The ASF Method has many applications. For factorable patterns, the ASF Method outperforms the prior method of Kling with more convenient and more versatile capabilities for the designer. To generate DPFs as in the wave-fold method of Kling, one begins with an approximate column cross-section and an approximate row-fold wave. These are combined as in the wave fold method disclosed there, but with no trigonometry calculations or amplitude adjustments for the row folds. The resulting surface will generally not be foldable. With this as the aspect surface, application of the Floating Method yields a DPF and with expected new row and column information. If one optionally applies the constraint that the column edges are coplanar up to translation, then the pattern generally will be factorable. The present invention generates all of the patterns generated by Kling and may generate prime DPFs outside Kling. For periodic patterns, it is preferred that a periodicity condition be included in the Floating Method.

Furthermore, starting with a factorable pattern for an aspect surface, with preferably a graphical user interface, the 3D image of the factorable pattern may be adapted directly. The designer may move vertices, add new vertices, adjust edge lengths, etc. directly on the three-dimensional pattern. The Floating Method is applied to assure the pattern remains foldable. Optionally, the condition that the column edges are coplanar up to translation may be imposed to assure the pattern is factorable. This offers convenience over Kling, as the designer may work directly in 3D without interpreting the cross section information through the designing algorithms. By omitting the condition on column edges our method also enables the designer to work within a much larger class of patterns, by incorporating slits into the folding pattern, inserting local facet or edge features, adapting the column edges so that they are not all coplanar, etc.

The ASF Method yields a new class of structures called prime folding patterns. These patterns may be periodic, semi-periodic, or non-periodic. The prime periodic patterns have numerous applications, including those of the factorable patterns found in Kling. In particular their use in laminated panels, for energy or shock abortion, numerous packaging applications, and numerous others. Because of their periodicity, the prime periodic patterns will naturally have an approximating solid that is either a planar slab or a cylindrical shell that is useful for laminated panels and other applications.

The ASF Method also generates semi-periodic surfaces. These may have either tapered periodicity, where the theme of the repeating unit repeats across the pattern but the scaling or proportions of the unit may change gradually, or an interrupted periodicity, where the repeating unit repeats across the pattern except for specific regions that have additional features incorporated into the pattern. The semi-periodic patterns may have a combination of tapered and interrupted periodicities. In general, semi-periodicity is modified periodicity. The ASF method advances the state of the art to semi-periodic folding patterns.

The ASF Method may be used to advance the design of foldable structures with no periodicity. Within the prior art for cases with many internal vertices, many cycles of faces, and/or curved faces, designing exact folding patterns is virtually impossible. One makes a trial folding pattern, attempts to fold it, makes measurements and tries again. The ASF method works closely with the designer's intentions and requirements, in the form of an aspect surface, shaping function, and constraints, and through mathematical computation adapts these to designing a foldable structure.

The aspect surface may be represented in many forms, such as a mesh, a polygonalization, a triangulation, spline surface, patched function graphs, etc. I will describe the triangulated case below. Each vertex has three coordinates. Vertices of the triangulation are located on vertices of the aspect surface and along curved edges to subdivide them into short segments in close approximation of the curve. Edges of the triangulation are first extended between the vertices to frame the edges of the aspect surface. Additional edges, triangulating the faces are added to represent the underlying ruled surfaces as closely as possible. Faces may be given a vertex in the middle and then triangulated or triangulate with choice of diagonal selection if it better suits the aspect surface, as in the case where the face has a preferred diagonal to accept folding. Dihedral angle energies may be assigned to the diagonal edges to encourage nearly planar faces, extra diagonals may be added (symbolically) to force planar faces, or central vertices may be given added curvature conditions. Additionally, the desired cone angle of each vertex may be entered at this time. This is usually 360 on all interior vertices, supplementary angles on cut angles, and varying angles along the boundaries of the sheet such as 180 along the straight sides and 90 on the corners if desired. The desired cone angle information may be deferred to later. It may also be fashioned directly from entry data formats.

The shaping function may be thought of as moving the aspect surface. For triangulated aspect surfaces, this may be may be the application of a function to the coordinates of the vertices. For the case where cuts are not being introduced, this may be extended to the triangulation continuously and piecewise linearly on triangle and edges. In particular the edges may connect the same vertices before and after applying the shaping function.

The shaping function may be used to add new local features to the aspect surface. New vertices and edges may be added to the triangulation by selected subdivision. It is preferable that the new internal vertices have at least four edges. It is also preferable that the new vertices have adjacent edges of both fold convexities, with at least three edges of like fold convexity. The vertices may be inserted in the edges or faces. Sufficient edges connecting the new vertices to each other and the existing vertices preferably are then inserted to produce a new triangulation. Cuts in the aspect surface may be introduced along edges by duplicating the edge twice and separating the bounding triangles. Chains of edges may be used for longer cuts, in which case the vertices within the chain are also duplicated. Preferably the duplicate vertices are constrained to have supplementary cone angles, or sum less than 360. Other configurations of edges such as a tree or triangle provide similar opportunities. To achieving cutting where there are no edges one first may insert edges to make a new triangulation.

After the shaping function is applied to the aspect surface, the resulting shaped surface will in general not be foldable from sheet material because the surface may have non-zero Gauss curvature. A method for adjusting the vertex locations so that the surface is zero Gausss curvature may be applied to produce a foldable surface. The method should be robust to work on a wide range of surfaces, not just for instance those that are relatively flat without diverse fold angles. The method should converge on zero Gauss curvature surfaces and not give false foldable patterns.

A Preferred Embodiment

With V the vertex coordinates in $R^{(3*n)}$, and A in $R^n$ the cone angles of those vertices, with F(V)=A, dF was calculated very easily. The nullspace of dF was about 2*n dimensional, so the pre-image of the angle deficit having the least sum of squared coordinates was retrieved and added to V. The goal was to move each of the vertices as little as possible and find a zero Gauss-curvature surface. Also the target cone angle of the vertices had a default of 2*pi but could be set for other values on the boundary.

Floating Function
Vertex gradient, etc. details
Surface Constraints
Periodicity Constraints
Desired conditions with "energy" give relative weighting
Ex.: dihedral

EXAMPLES

Chevron Pattern in wind turbine blade (gradual periodicity)
Aesthetic Bowl with curved facets
Factorable Periodicity figure on convenience for designer
Prime Periodicity having a rotational symmetry
Prime Periodicity facet column edges not parallel
Flow chart of ASF Method I. Continuous No-Stretch Processes for Producing Zero-Curvature Structures Two general methods are disclosed for continuous no-stretch processes for producing zero-curvature structures, namely, a gradual folding technique and a bunch and crunch technique.

A preferred method for designing the gradual folding technique may be described as follows: one takes a long folded sheet of the desired geometry, and unfolds one end by pulling apart the pattern while applying force to flatten it. This may be done either by actual experiment or by calculation or by simulations. The folding pattern is then sampled at incremental positions, starting with the flattened end and proceeding to the fully folded end. Rollers pairs with the pattern negatively imprinted on them in each of these positions are arranged in analogous sequence. Alternatively stamping dies in the sampled patterns may be positioned in sequence. (Or the entire gradually folded sheet may be cast in two dies for high performance in an iterative stamping operation) The material is fed through. Problems include the difficulty in changing product specifications and the length of the sequences needed to draw in the material in laterally.

The bunch and crunch method is designed by taking a folded sheet in the desired specification, measuring the lateral contraction ratio, designing a pre-gathering method for giving the sheet longitudinal corrugation with the same contraction ratio, and designing pattered rollers with the folded sheet negatively engraved on them, and linking these so the corrugated material with the same contraction ration of the folded sheet is fed through the patterned rollers. Note the final roller in the bunch and crunch method has the same geometry as the final roller in the gradual folding method.

The present invention comprises an improvement on both of these methods. The folded material is selected. Rolled sheet is longitudinally pre-gathered (by any of the numerous means possible) with the same contraction ratio as the selected folded material. Then two or more folding stages are introduced. The final stage may be a roller pair with the pattern negatively engraved on it. The previous stage may also be a roller pair with a roughly similar design, however its geometry is preferably calculated by a method distinct from both state of the art methods above.

The calculation may be done as follows: The desired folded sheet has been selected. The pre-gathering profile is selected with the same (lateral) contraction ratio. The crease tessellation pattern is drawn on the unfolded sheet. This tessellation is examined on the pre-gathering profile. As the folding process contracts the sheet both longitudinally and laterally, and the pre-gathered material only contracts the tessellation in the lateral direction, the approximate parallelogram (or other) shape on the pre-gathered material will be longer longitudinally than the folded sheet. A series of rollers (at least two pairs) may be designed so that the final roller imitates the final folded sheet, the earlier patterned rollers have the same lateral dimensions as the final roller, but incrementally progress in their circumferential proportions from the long parallelogram on the pre-gathered corrugation material to shorter circumferential proportions on the final roller. Preferably the designing is such that the crease vertices on the sheet, as it transforms from corrugation to folded pattern, migrate minimally in the longitudinal direction.

The designing technique applies to sequential stamping as well. In general for full performance it may be preferred for both rollers and stamping and other means of forming the crease pattern.

To produce a folded sample that is at one end the desired pattern and at the other end the longitudinally corrugated sheet, with a transition sequence of the folded pattern being applied at the correct crease tessellation positions on the material. As the fold creases get "dented" into the corrugated sheet to deeper depths, the period length will shorten longitudinally. Also curved creases and other phenomenon will adjust progressively until they become the final folded pattern. This complicated geometry is a preferred material flow, and dies or rollers or articulating or other devices preferably implement the geometry with matching structure.

II. Continuous Lateral-Stretch Processes for Producing Zero-Curvature or Nearly Zero-Curvature Structures For many reasons the zero-curvature or nearly zero-curvature structures are valuable, even if they are produced by a process that involves some stretching. Each material has a maximum strain rate before it will fail, and generally it is preferred to stay within this strain rate. The procedure has many variations. A preferred embodiment is as follows:

1. Sheet material is prepared to have a usable lateral ability to stretch. It may be prepared already on the roll, or while the sheet is moving as a preliminary production stage.

2. The material is pre-gathered so that by combining the effect of the contraction ratio with the allowable lateral stretch will give a sheet of proper width for the final produced zero-curvature (or nearly zero-curvature) structure.

3. The sheet is fed through a forming procedure that imparts the geometry on the sheet. This may involve a pair patterned roller, a pair of dies, articulating devices or other. This may be a sequence of forming steps as (I) above.

Illustrations in Examples:

A desired zero-curvature surface is selected. Sheet metal of the same projected width on a roll is fed continuously through a slitting machine. The slits run longitudinally. The sheet is planned to stretch lacteally to form a wider sheet of expanded metal with the same intrinsic width of the selected zero-curvature surface. In this situation no pre-gathering is needed because the sheet will expand the full amount. The sheet is fed through patterned rollers. Inside the rollers the sheet expands laterally, while contracting longitudinally, so the projected image goes into the rollers faster than it comes out.

The same slitting procedure works for paper and other materials.

Cloth may be used with diagonally running fibers, so that the bias accomplishes the same effect. The cloth may be pre-gathered partially to add to the lateral width requirement of the selected zero-curvature surface. This would be helpful for cloths with matrix binders or other added ingredients, and in other cases where the bias does not expand easily to accommodate the full contraction ratio. The final forming rollers stretch the sheet tightly, and this eliminates wrinkles or other defects.

Annealed or plastic metals may be used. If needed some pre-gathering may augment the plasticity of the metal. The final forming rollers stretch the sheet tightly, and this eliminates wrinkles or other defects.

Plastics and polymers generally admit great deformation before failing. These sheets may be prepared by warming them or adding plasticizers.

Paper does not stretch very much. But by planning the pre-gathering so that the sheet will still need to stretch within its limit, would stretch the sheet tightly, and eliminate wrinkles or other defects.

Paper may be treated so that it does stretch. This may be similar to crepe paper. This may be accomplished by aligning and orienting the fibers to facilitate lateral strain. Additional fibers with greater elasticity may be mixed in. The paper may be wetted with water or other liquid. Elastic polymers may be added. The paper may be embossed with a texture to make it stretchable. Combinations of these methods and/or others may be employed. Once prepared to have a desired lateral capacity to stretch, pre-gathering may be employed as needed for the next step. The sheet is then processed through rollers, dies, or other means to produce the zero or near zero curvature surface.

For very fine patterns, it may be preferred to use an incremental stamp. This is related to the difficulty in using rollers with many circumferential periods.

These examples show many ways to material may be prepared to have lateral deformation. The final creases may be imparted into the material by a pair of rollers, a sequence of rollers as in I) above, by dies, by articulating devices, etc. Because the material is programmed to stretch laterally, it is pulled tight when the creases are formed and this improves the quality of the surface.

One way to understand the process is that a rectangular length of sheet after it is formed into a zero-curvature surface by this process, if flattened or unfolded would be wider than it was before it was formed into the zero-curvature surface, and generally but not always the formed rectangle if flattened or unfolded would be shorter than the pre-formed rectangle. In contrast the no-stretch folding procedures the rectangles would be the same size, up to errors caused by the memory along the fold creases.

III. Roller Designs

There is a difficulty in using rollers for these processes that do not force the sheet to stretch greatly in the longitudinal direction. The difficulty is that for rollers with many circumferential periods, the proportions near the tangential region are such that many teeth of the roller engage the sheet material simultaneously. As the teeth go deeper into the sheet region, the sheet contracts in the longitudinal direction. However by tangent approximation, the teeth spacing in the longitudinal direction remains constant. Thus there is a relative velocity in the longitudinal direction between the roller and the sheet. The larger the roller circumference is to the period length, the more teeth the sheet will have to slide over due to this relative velocity.

For patterns that are very fine relative to the width of the sheet, keeping the number of periods around the roller low will give a long slender roller. The finer the pattern, the more difficult to keep this roller from deflecting during operation.

The problem is solved here for these folding, zero-curvature, or near-zero-curvature uses, by several means:

1. Multiply fixed shafts
2. Dashed shafts
3. Single backer roller
4. Double backer roller
5. Combinations and variations
6. Non-roller solutions IV. Articulating Disc Machine This machine continuously produces zero-curvature or near zero curvature materials. The surface is selected. The contraction ratio is calculated. The sheet material may be prepared to stretch laterally. The material is pre-gathered so that the combined effects of the pre-gathering and the lateral stretching give the intrinsic width of selected surface, and the projected width of the pre-gathered sheet equals the projected width of the final structure. Instead of using two or more rollers as I) above or one or more rollers as II) above, an articulating rack of wheels oscillates back and forth. The wheels may be sharp edged or not, and may be backed by rubber or other material rollers, which may be smooth cylinders, with preferably oscillating mechanisms. This may produce a sine wave type pattern, or other patterns of the same or various convexity sequences. In some cases the produced pattern is the desired pattern, in other cases it is a "roughing out" that is then followed by patterned rollers, patterned dies, articulating devices or other.

One advantage is that each wheel and its backing may provide positive grip on the sheet material with steering capacity relative to the intrinsic sheet geometry. This gives added control. For instance, chevron type patterns with row ridges separate substantially are problematic for the Rutgers machine. Here the non-interlocking nature of the pattern's ridge folds is unimportant—each wheel grips and steers in a zig-zag pattern. It may also be desired for producing sharp corners in the formed pattern to use wheels with a zig-zag circumferential profile with as little as one period per revolution. These may oscillate in parallel. The backing rollers may oscillate in parallel.

Another advantage is the same machine will produce patterns with a variety of proportions by changing the oscillation rates.

V. Die Geometry

As mentioned in I) above, it is advantageous to convert from pre-gathered corrugation type material to zero or near zero curvature surfaces by imparting the geometry in a series of steps. As the tessellation crease pattern on the smooth corrugation contracts longitudinally during formation, the steps should incrementally shorten longitudinally so that the crease vertices move minimally relative to the intrinsic sheet. Exact dies may be designed using our algorithms, or by an experimental method explained as follows.

A sheet marked with the desired sheet tessellation is formed into the desired surface on one end, and held in corrugation profile in the other end. The profile was calculated to have the correct contraction ratio in conjunction with the planned lateral stretching if any. It is preferred that the lateral periods of the corrugation and the tessellation have ratio 1:1, 2:1, 3:1, 3:2, or 4:1, but irregular frequencies may produce results as well. In the projection the tessellation is distorted from the final pattern's projection primarily by being longer longitudinally on the corrugation.

The die is designed by successively indenting on the tessellation crease lines, gradually more towards the folded end, with the correct convexity from above or below. Precise design depends on the frequency ratio, but generally the points on the surface furthest from their lateral position are pushed first, with ample space between the mating dies, and incrementally the sheet pattern transforms from the undifferentiated shape or the tessellation on the corrugation to the pronounced shape of the tessellation on the final patterned surface. With this progression the period length changes, and the spacing between the dies may lessen. The final incremental die form may have little or no excess space in the die pair.

VI. Fluid Method

This method adapts to continuous process with or without lateral stretching and of the types gradual folding, bunch and crunch, I) above, and discrete parts manufacture. In each case there is a desired material flow involving geometry that moves three-dimensionally with the process. This can be implemented by dies, rollers, etc. The idea here is to use air jets, water jets, etc. to articulate the motion of the material flow.

The discrete parts machine for paper may have two flat dies with arrays of air holes positioned across them. There may also be arrays of vacuum holes. Each jet or vacuum may be controlled independently, and preferably through a computer. The pressures (and optionally directions) of the jets change during the contraction due to folding. The paper may be etched or stamped on the desired fold lines in advance to induce precise crease lines.

For the gradual folding method, the material advances between a long pair of plates with arrays of independently controlled jets. The programming follows the motion of the tessellation. The tessellation on the sheet is preferably marked by stamping or etching or otherwise prior to entering the air dies, to promote precise fold creases.

For metals and other materials that accept water, the analagous devices may be employed. The momentum of the water may add to the effectiveness.

To understand the process one can recall a theater curtain falling to the floor. The buckling pattern one sees is the natural low energy solution for the material, and closely resembles the sine-wave pattern or the chevron pattern familiar in the folding technology. These air and water dies uses the physics intrinsic to the sheet to guide the material flow to the natural low energy solution represented by the folding pattern. In many ways the fluid jets would be these least invasive handling of the material and ideal for controlling the material flow.

Also the complete versatility of the programming potential for such a pair of dies may enable many pattern types to be produced on the same machine with no re-tooling. These dies may be combined with rollers, hard dies, and other mechanisms in other production sequences.

VI. Cornering Dies for in-Line Sheet Production

Sheet material is fed continuously through many machines and sequences. Rollers are naturally employed for conveyance and to perform operations such as printing or stamping. Generally the larger roller diameters are less destructive to the sheet, due to the tangency area becomes more nearly linear, and other factors. Surprisingly it is useful to have material flows with sharp corners, quite opposite to using large radii rollers. These cornering operations may be achieved by pulling a sheet over a guide with an edge to it, and by other means as described later.

The value in using cornering in a material flow comes from the value of keeping in plane distortion low, and requiring lateral movement of the sheet profile. To understand the advantage, one recalls zero-curvature surfaces are piecewise ruled surfaces. The non-smooth singularities form a 1-complex. In particular there are corners or edges separating the conical cylindrical, or tangent indicatrix type regions. Thus to take a flat sheet and convert it into longitudinal corrugation or tube, either a very long process must be used that dampens the 1-complex, or a shorter process may be used with recognizable migrating creases. To implement these creases it is preferred to use cornering mechanisms.

The simplest cornering mechanism is a low friction object with an edge. Preferably the edge will be curved lengthwise, and its cross section will have a radius of curvature greater than the radius of curvature of the sheet being processed. A glazed ceramic may be used for a cornering guide. In some applications a belt may pass over the cornering guide between the guide and the sheet. In some cases the cornering guide may be a very small diameter curved rod, with bushings on it, or several rods approximating the same curve.

The side of the material flow with the larger angle may also be used as a cornering mechanisms. Generally the sheet needs positive pressure to push around an outer cornering guide. The guide may be simply the negative mold of a inner cornering guide. This may be assisted with rollers or roller pairs near the corner.

A mandrill describing both sides may be used.

The laterally curved corner may be flanked before and after with segmented roller pairs to induce the cornering.

Air jets may be used as a cornering guide.

VII. Multi-Laminate Materials

The patterned sheet materials designed by this new technology may be laminated in multilayer materials. These layers may include plane sheets, corrugated sheets, linear strands, nets, plane surfaces with holes, patterned surfaces with holes, felts, foams, discrete objects, etc. The structures go beyond the three component system—face/core/face—preferably with at least five layers. The sequence of layers preferably has a symmetry pattern, but variations from the symmetry pattern are sometimes preferred. Preferably at least one layer is a zero-curvature (or near zero-curvature) doubly-periodic structure, or an approximate DPF with variation from the strict periodicity for effects as described in the new designing methodology technology.

EXAMPLE

The double-square wave pattern (Pattern family Tessellation shown FIG. 1) and patterns with the similar wave-convexity sequence fit nicely into a standard corrugation sheet with "hex wave" pattern. The DPF proportions may be customize for bonding regions with the corrugation. Multiply sheets can be stacked C-D-C-D- (C=corrugation, D=DPF) with the corrugation turning 90 degrees or reflecting over between DPF sheets if desired. The spacing between the successive corrugation sheets may be adjusted by DPF design. The corrugation or DPF may have holes in it to provide added gluing relationships, lightweight, porosity, and other qualities.

Another example uses a double-square wave pattern D-D-D-D for its resilience and flexibility and good gluing bonds. These bonding areas are labeled "U" and "L" for the upper and lower bonding plates respectively in FIG. 1.

Figure 2B:
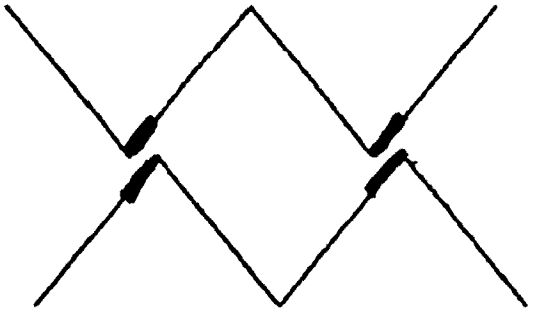
FIGS. 2A-2D show column cross sections with glue layers for an embodiment laminating process.
Figure 2D:
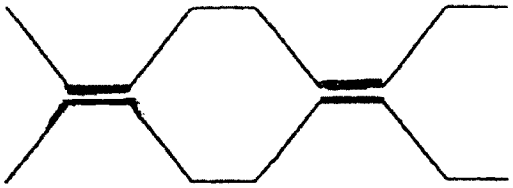
Figure 2A:
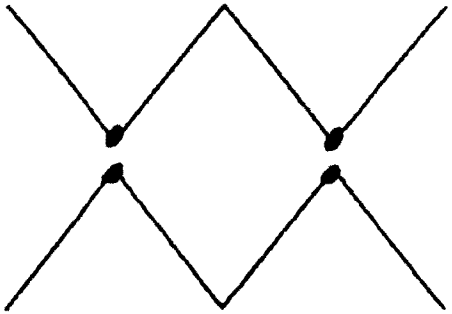
Figure 2C:
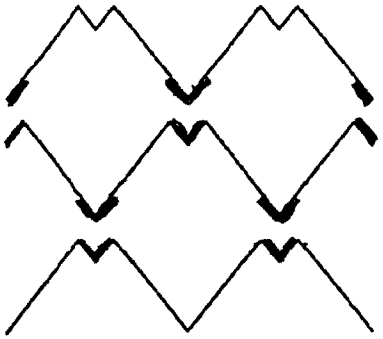
Figure 5:
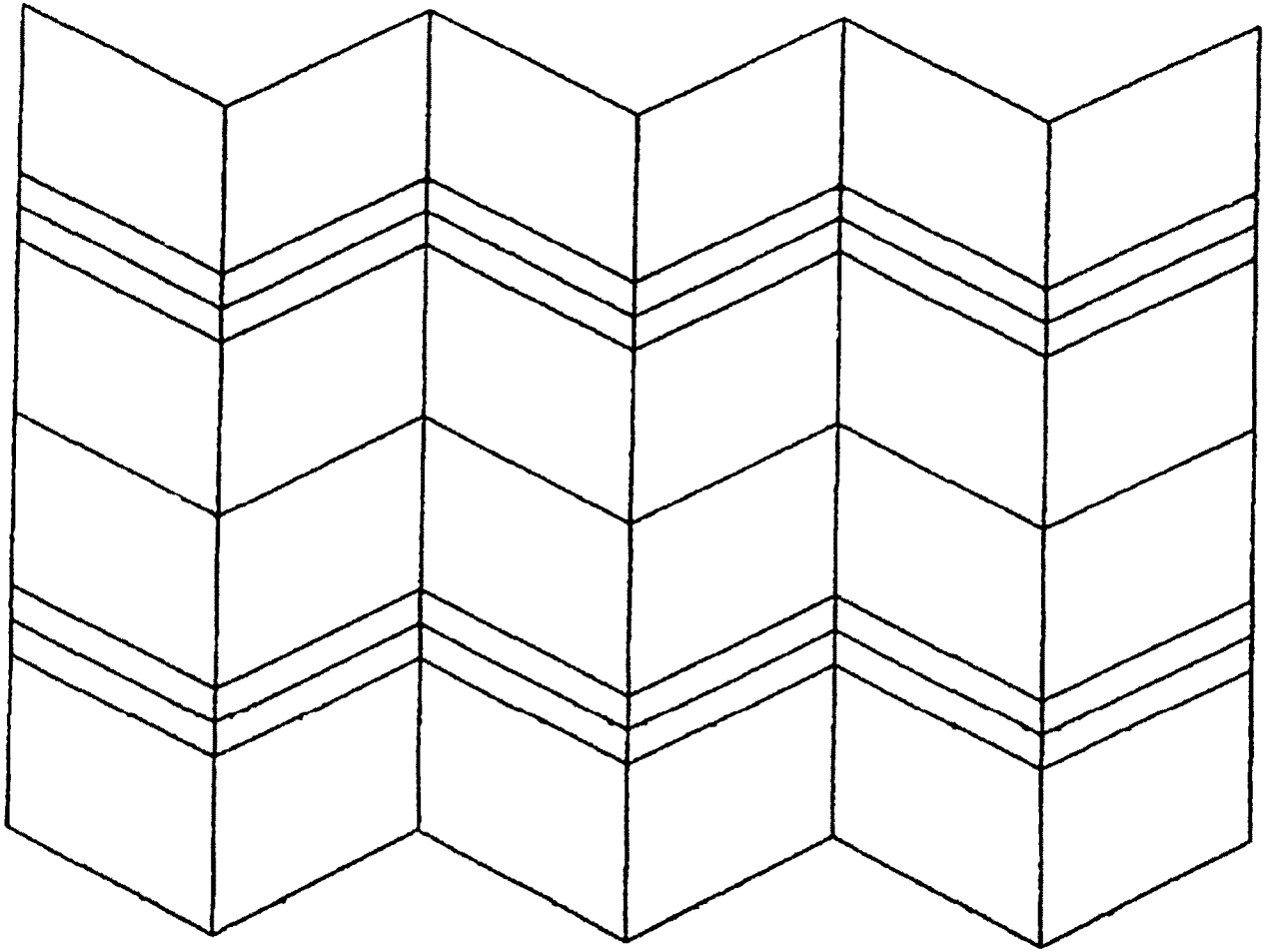
FIG. 5 shows the pocket design applied to the chevron pattern.

The chevron pattern may be bonded in a D-D-D-D-sequence to form a multi-laminate sheet by matching the ridges of one layer to the valleys of the next. FIG. 2A shows the column cross section for two layers about to be laminated with their glue edge cross-section marked with a dot. A flexible glue or adhesive may be used to produce a block that compresses completely as the chevron pattern does. By adapting the bonding area to be face to face, with the neighboring sheets part way nested as in FIG. 2B, the glue area belongs to portions of their faces as marked in the cross section, and this may be done to enable less flexible glues to be used and still permit the entire structure to maintain its integrity while being flexed. Alternatively the ridges of the chevron pattern may be reversed locally, yielding a pattern who's column wave resembles a (0,0), (4,4), (5,3), (6,4), (10,0) pattern, to pocket the next layers valleys and allow for adhesive strength. FIG. 2C shows the column cross section and glue areas of the pocket design. FIG. 5 shows the pocket design applied to the chevron pattern.

The sine-wave type pattern with curved row wave also may be glued ridge to valley similarly FIG. 2A. It may be slightly nested for face to face bonding FIG. 2B. It may have a pocket on its ridges to attach to the next layers valleys FIG. 2C. The sine wave type pattern is also flexible in the glued pattern. It may be preferred because any change in the shape by 'unfolding' it causes the surface to change mean curvature which absorbs energy. In particular, a sine wave multi-laminate with a hardening mix in the material, that is cured after forming it, would be very valuable for energy abortion. Resilient polymers give an overall springiness, fracturing polymers or ceramics may consume a lot of energy on impact. The column cross sections 2A 2B 2C in the figure are useful for laminating DPFs composed from any row wave. Also by slightly deforming or crushing the ridges similarly to FIG. 2C but with a flattened top, multi-laminate materials may be formed with enhanced glue areas. This generally produces irregularities near the vertices but within the tolerances of the materials this may be preferred.

Figure 3:
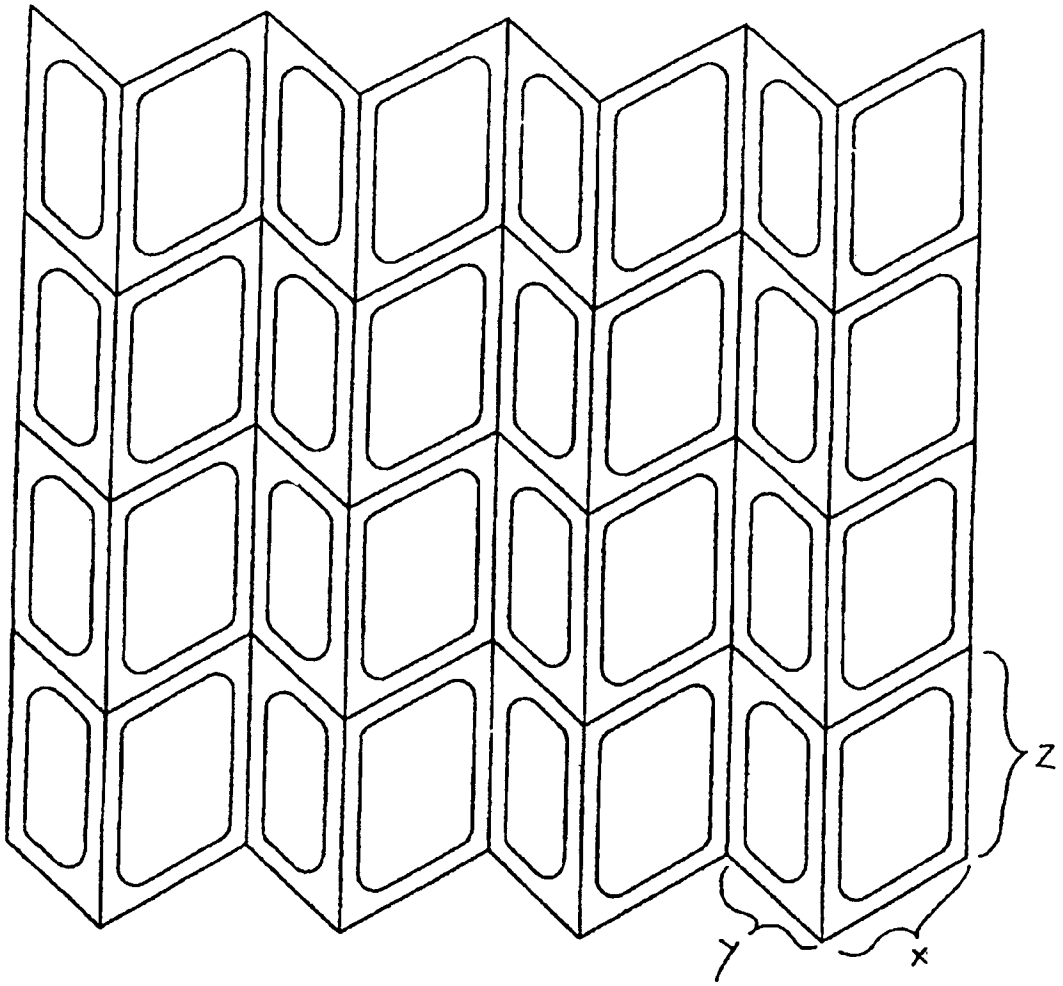
FIG. 3 shows a tessellation with cut holes.

There are many other combinations for specific applications. In some cases holes or slits are cut in the sheet to add flexibility. FIG. 3 shows an altered chevron pattern with lengths "x, y, z" marked. By gluing this pattern in a ridge to ridge multi-laminate as described above, and expanding the pattern fully, if the edges are allowed to twist it will produce a 3D rectangular block net with dimensions on its rectangular unit x, y, z. Note by laminating planar nets with the pattern in the figure together the 3D net may also be obtained.

Global effects may be realized by considering the relative Poisson's Ratios between neighboring sheets. For instance, two sheets glued on a common grid of contact plates, may both be flexible independently but have different relative contraction ratios in the two directions of the grid. Forcing the sheets to contract would induce a curvature in the laminated pair. Neighboring sheets with more conflicting contraction rates may exhibit controlled rigidity and other stress-strain properties.

One application calls for a multi-layer material with many pathways of small diameter, the ability to flatten easily in several directions, and/or the resilience to bounce back to the 3D structure. This may be used as a highly absorbent material, for household clean-up applications and others. The paths in the bulk material may extend clear through in many directions. This enables the capillary action to reach the entire engineered sponge quickly, easy rinse out, and the flattening capacity provides a wring-out. Moreover the systematic pattern gives durability over the randomly configured sponges, analogously to woven cloth outlasting felt. Laminate patterns suitable for this application include the multilayer chevron pattern with perforated sheets, the double square-wave pattern mentioned above, and others.

Other applications include padding and cushioning materials, cloth like sheets, new bulk materials, construction materials, a light weight sheet similar in applications to particle board. Packaging materials, paper based products in applications similar to Styrofoam, sheet materials for use in mold forming processes, sound absorbing applications, and numerous others.

VIII. Novel Manufacture Process for Multi-Laminate Folded Structures

Figure 4:
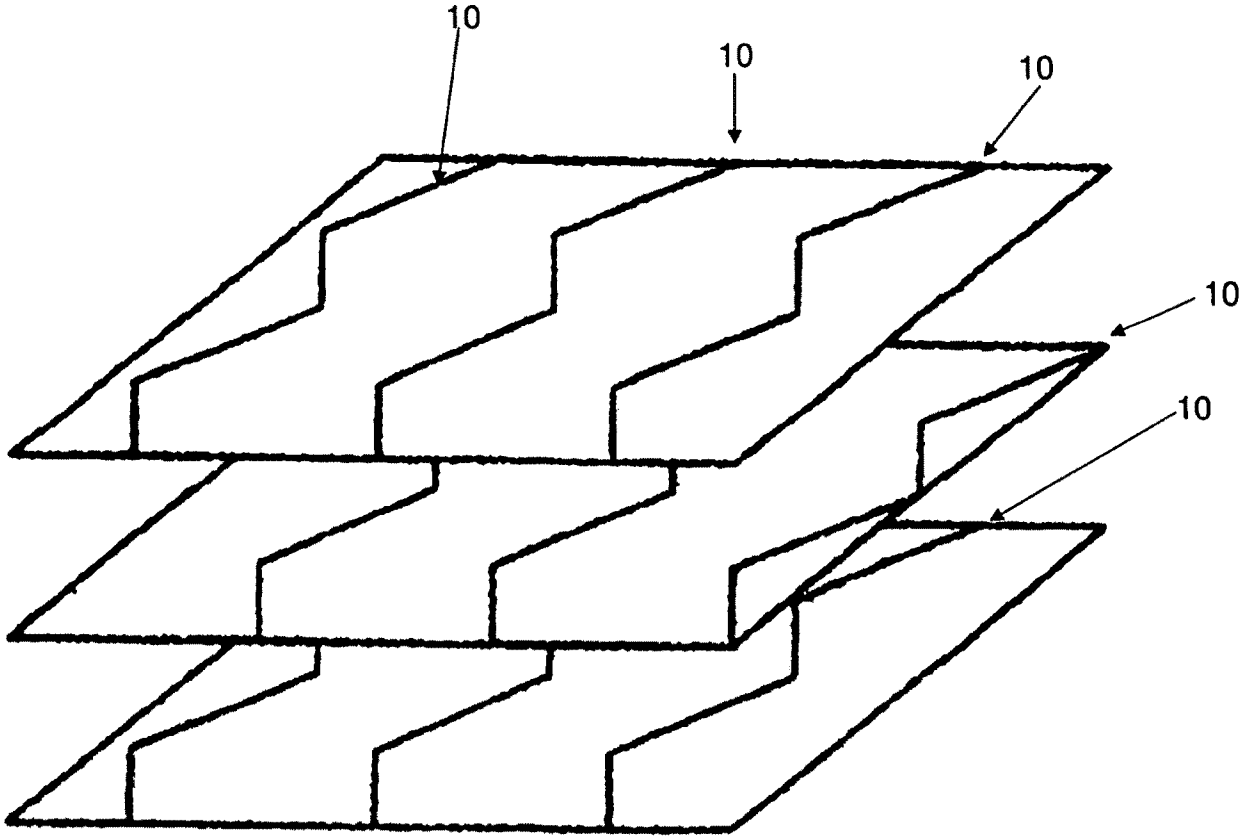
FIG. 4 shows a glue pattern with glue lines 10 to produce a multi-laminate chevron material.

One inexpensive novel procedures for manufacturing multi-laminate structures is described below. Flat sheets are printed and stacked. The printing includes an adhesive or gluing pattern that joins the neighboring sheets at pre-calculated positions. The sheets will later be moved apart to form the structure. This is similar to honeycomb manufacture, where the glue is placed in parallel lines, offset alternately with each layer. Here instead the adhesive may be in any pattern that is designed to accommodate the sheet behavior. Alternately offset sine waves, or zig-zag waves (FIG. 4), yield the corresponding multi-layer blocks. The full crease tessellation pattern may be stamped or etched before gluing the sheets to help clarify the folded pattern. The sheets may be than folded (expanded) in the same procedure as honeycomb.

IX. Activated Manufacture Process for Multi-Laminate Folded Structures

In addition to the adhesive bonding the neighboring sheets above, components may be printed that are later activated to induce the folding motion. Foaming agents, compounds for off-gassing vapers or steam, expanding or contracting materials, layers of stretched elastic strands, sheets etc., polymers for later adding stiffness, non-activated adhesives, and others may be printed or applied to the sheets. These may be later activated, by applying heat, moisture, microwaves, etc. Manufacturing processes are discussed below for discrete parts with custom curvature, and a continuous process for multiple layers.

Figure 6:
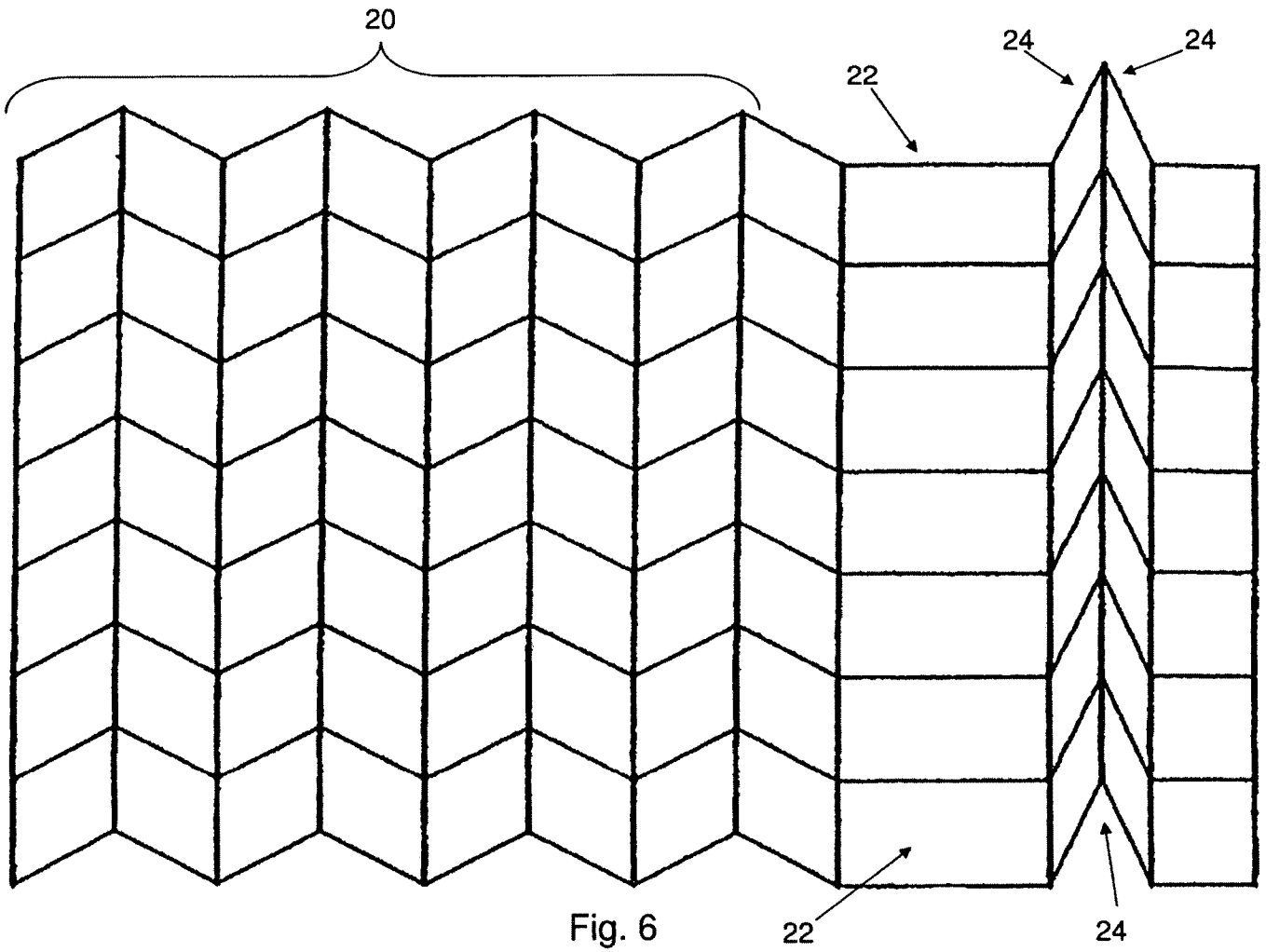
FIG. 6 shows forcing locations for a foaming agent, including a main pattern 20, forcing areas 22 and a tie area and stop 24.

For example a flowerpot or other container is desired with possible curves and undercuts. This technology may be a preferred alternative to using a multi-piece mold that applies to a wide range of materials. The folding technology design the container is as follows. Mathematically the container is divided into nested shells for each layer of laminate. These shells are stretched out onto the plane. The directions and amount of contraction at each point from the plane pattern to the flowerpot is know by the Gauss map. A chevron type pattern or other pattern is designed to locally fit the required contraction ratios. The tessellation of the folding pattern is optionally stamped or etched into the sheets to help induce the folds. If multiple sheets are being laminated, the flower pot is divided into mathematical shells, and each shell is calculation. Glue is printed on the ridges. A foaming agent is applied to the valleys between layers, contracting agents may be applied to valleys also. The pattern may have been augmented to have some valley angles greater than 90, these may receive more foaming agent. This is because generally the pressure will seek about a 90 dihedral angle, so by applying more agent to the wider fold creases the hinging action will force the entire tessellation to fold giving some acute dihedral fold angles. FIG. 6 shows the forcing locations for the foam. The prepared sheets are stacked with valleys aligning to the ridges of the sheet below. The sheets may then be activated, by heat, moisture, microwave, etc., causing the foam to foam or the contracting agent to pull the facets into folded position. (This pulling may be done by surface tension on the nano level) The many facets move and interact together creating desired custom curved object.

With these customized folding patterns that may imitate the contraction found in the differential of the Gauss map, many post processes are possible. Facet to facet contacts, which may have been programmed into the pattern as stops, can be glued or joined by adhesive foams or specific adhesive printing. The overall structure may have polymers or other compounds that cure giving an added structural composition. The overall structure may be dipped or painted or otherwise receive application for enhancing the object's appearance or physical properties. The overall object may be used as a blank in secondary molding or forming operations. Slits or holes between layers may have been planned to give the foam a monolithic quality. Resins, polymers, ceramics or other ingredients may be put in the sheets before folding to be post cured or for added interactions.

There are many other similar techniques to activate the multi-laminate geometries. Sheets can be designed to fold and lay back in the plane. In some cases activating these patterns to unfold to a thicker position may be useful. Potential energy can also be stored in the fold hinges, or elastic fibers, and released by heat or moisture or other methods.

Figure 7:
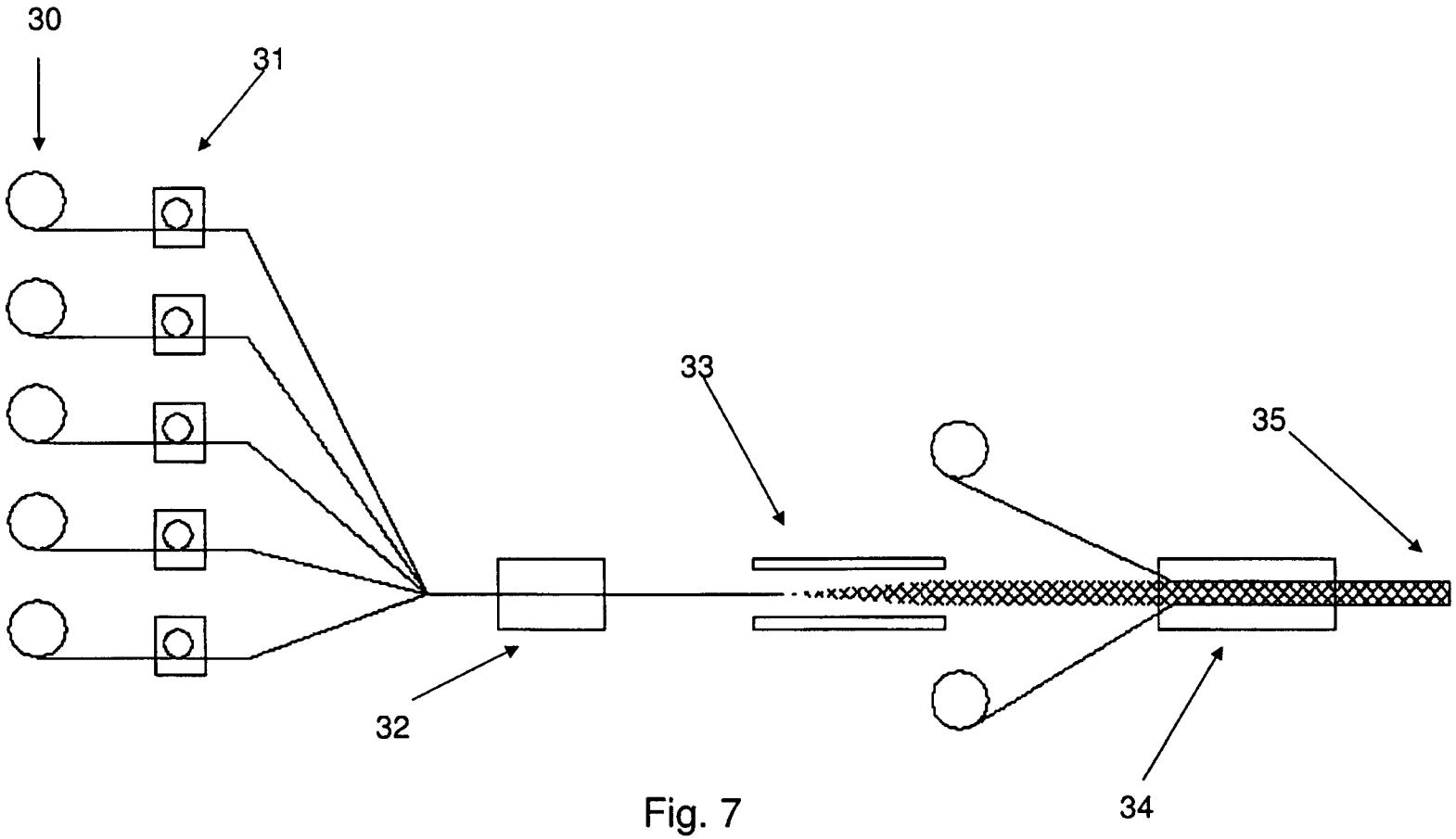
FIG. 7 shows a continuous forming process for planar sheets that includes sheet material 30, application of adhesives and expanders 31, first lamination 32, activation of expanders 33, face lamination and final cure 34, and finished structurally designed material 35.
Figure 8:
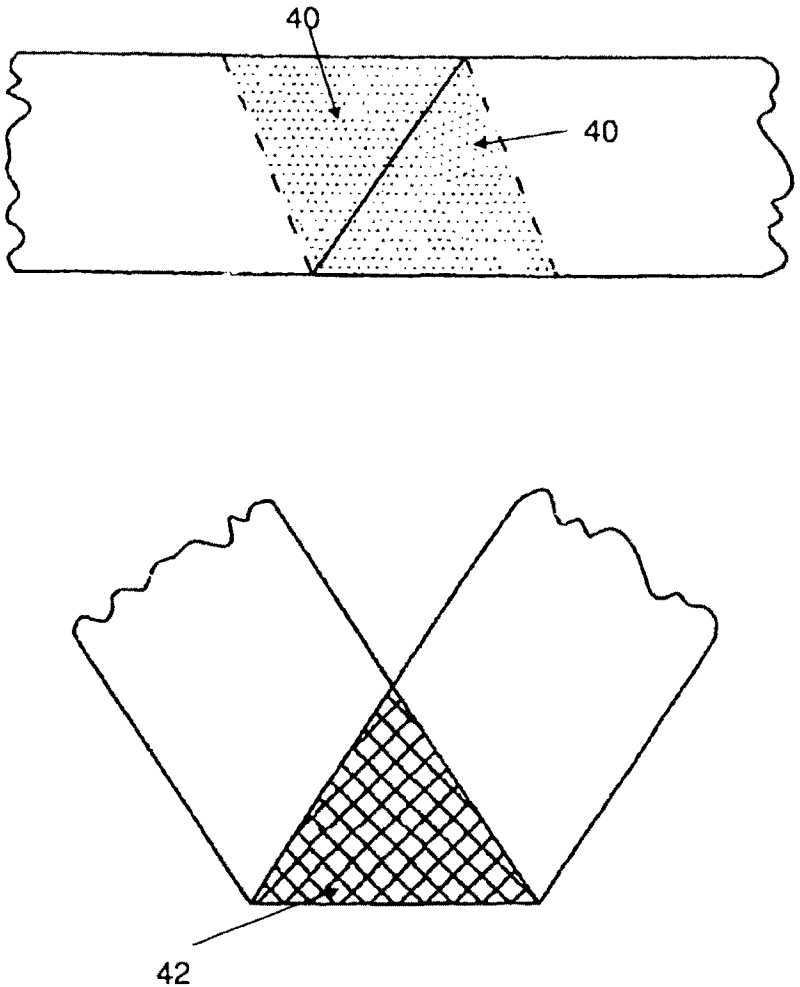
FIG. 8 shows an application area 40 for adhesives or bonding compounds, and stop and ties areas 42 in a final 3D pattern.
Figure 12:
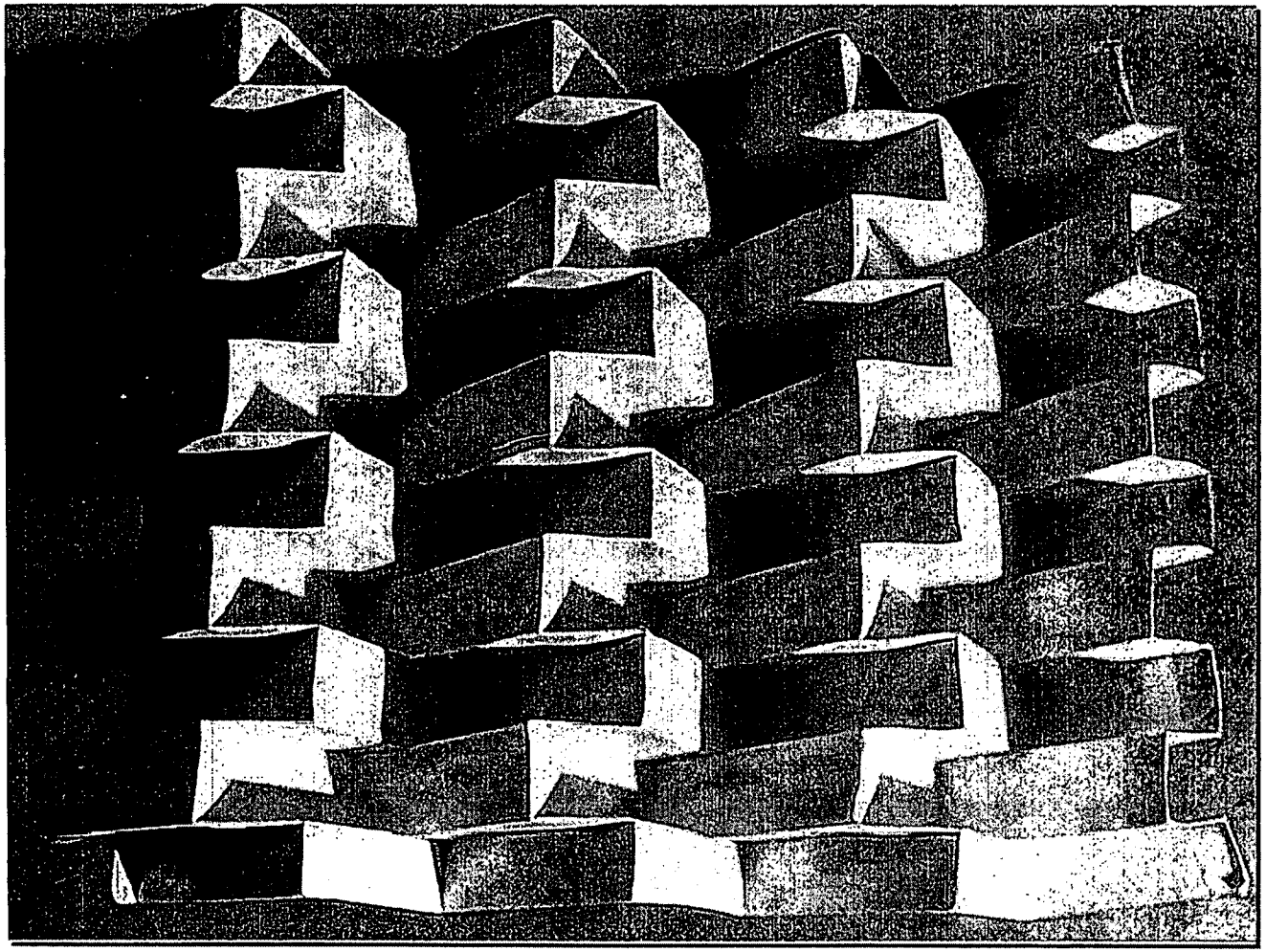
FIGS. 12-24 show embodiment folding patterns.
Figure 13:
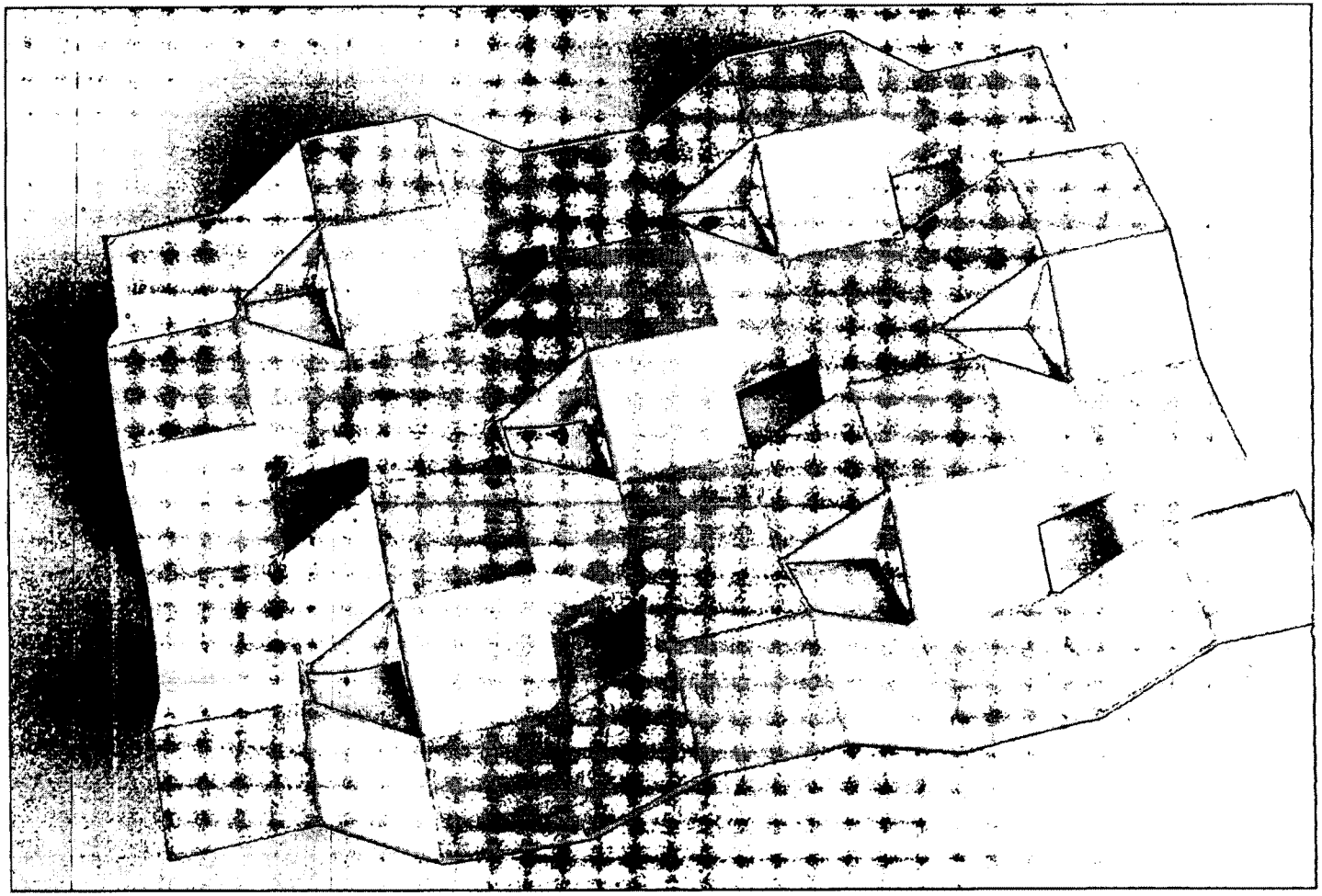
Figure 14:
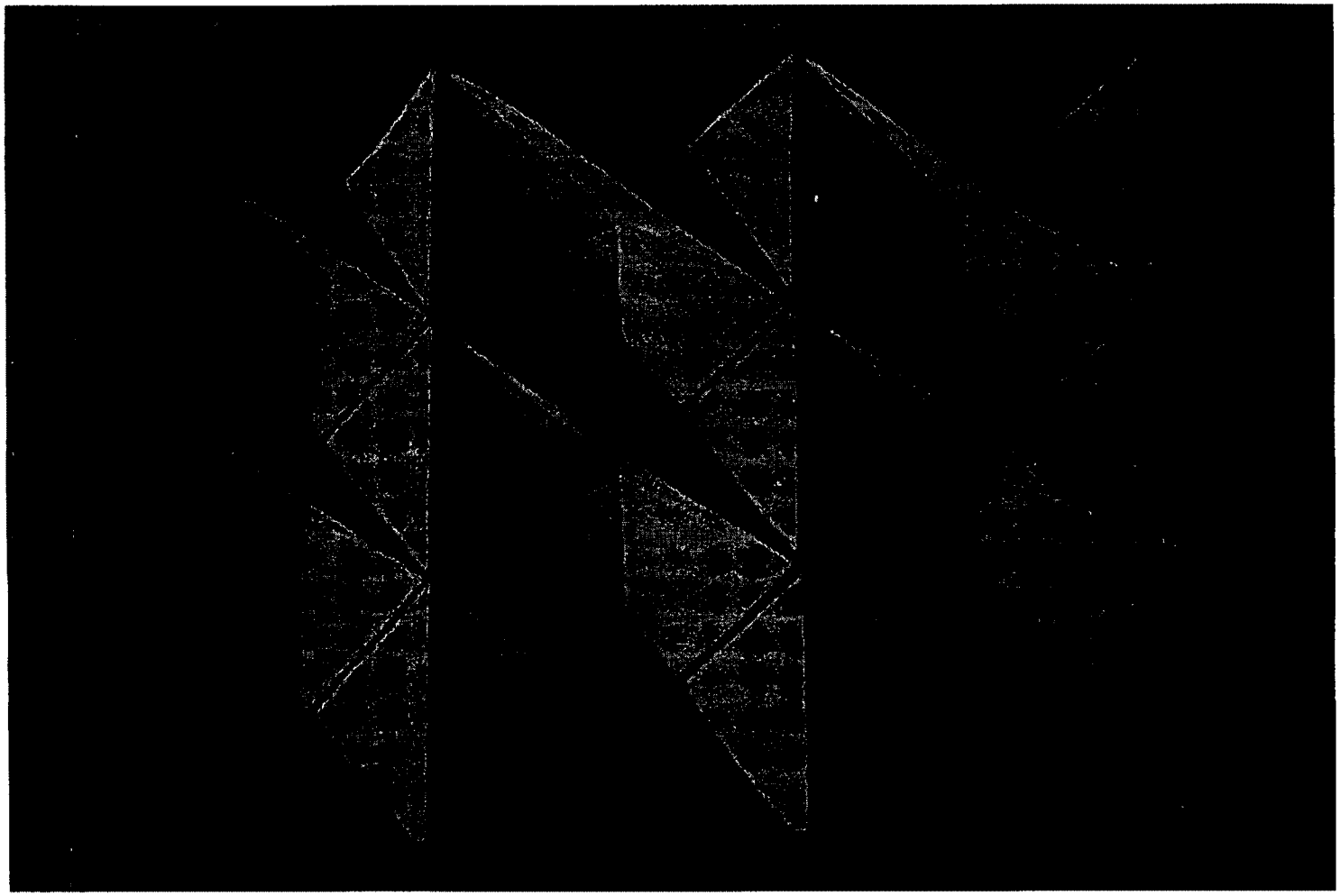
Figure 15:
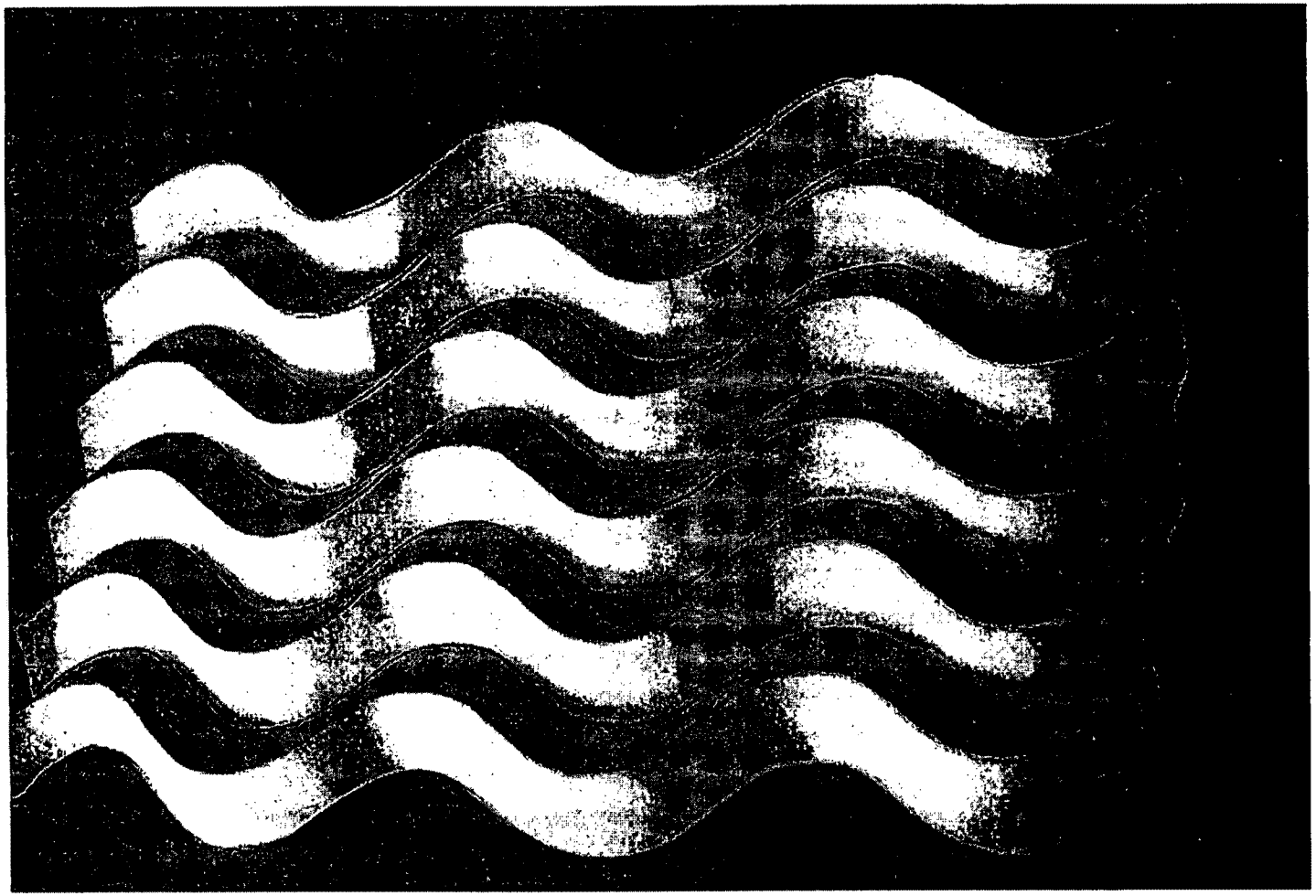
Figure 16:
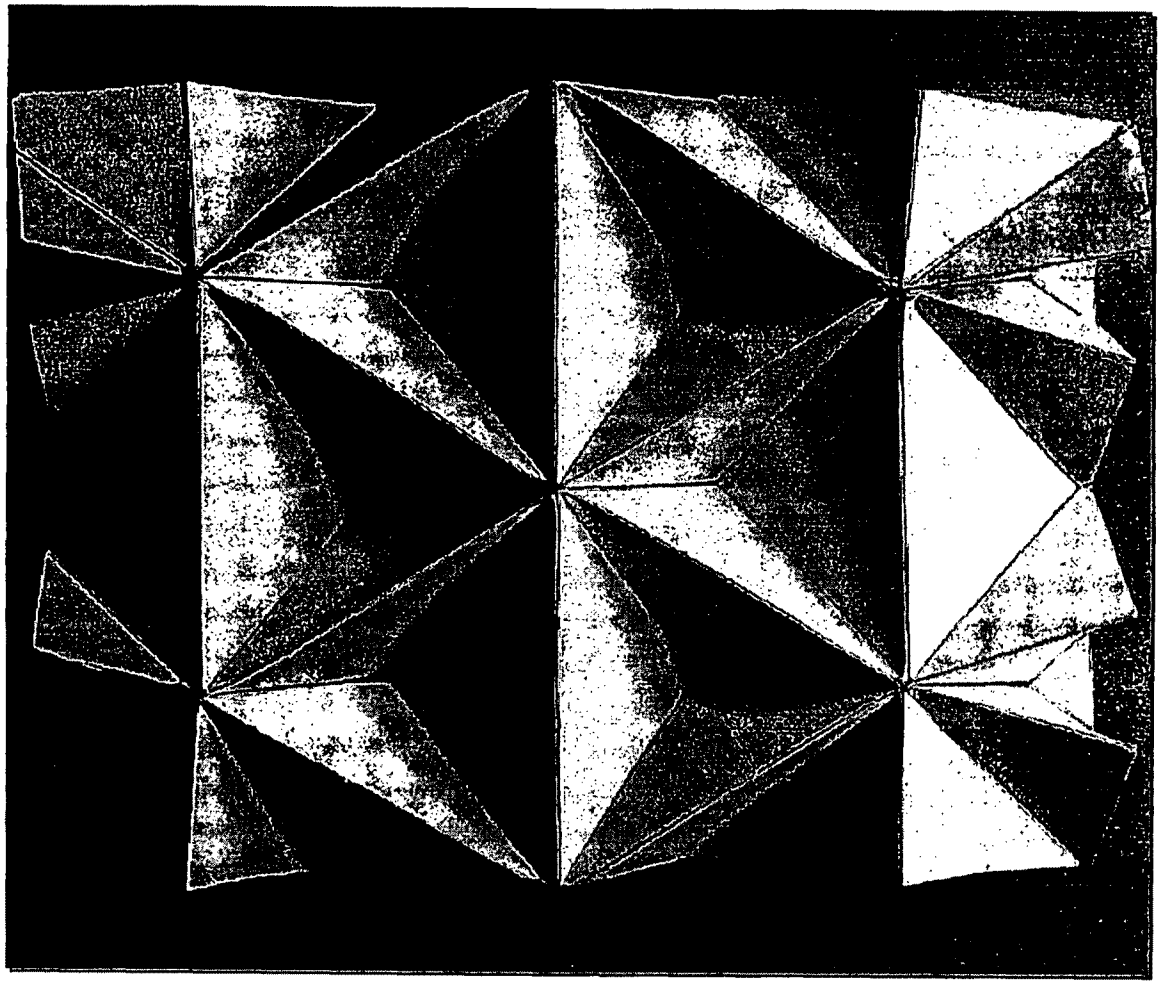
Figure 17:
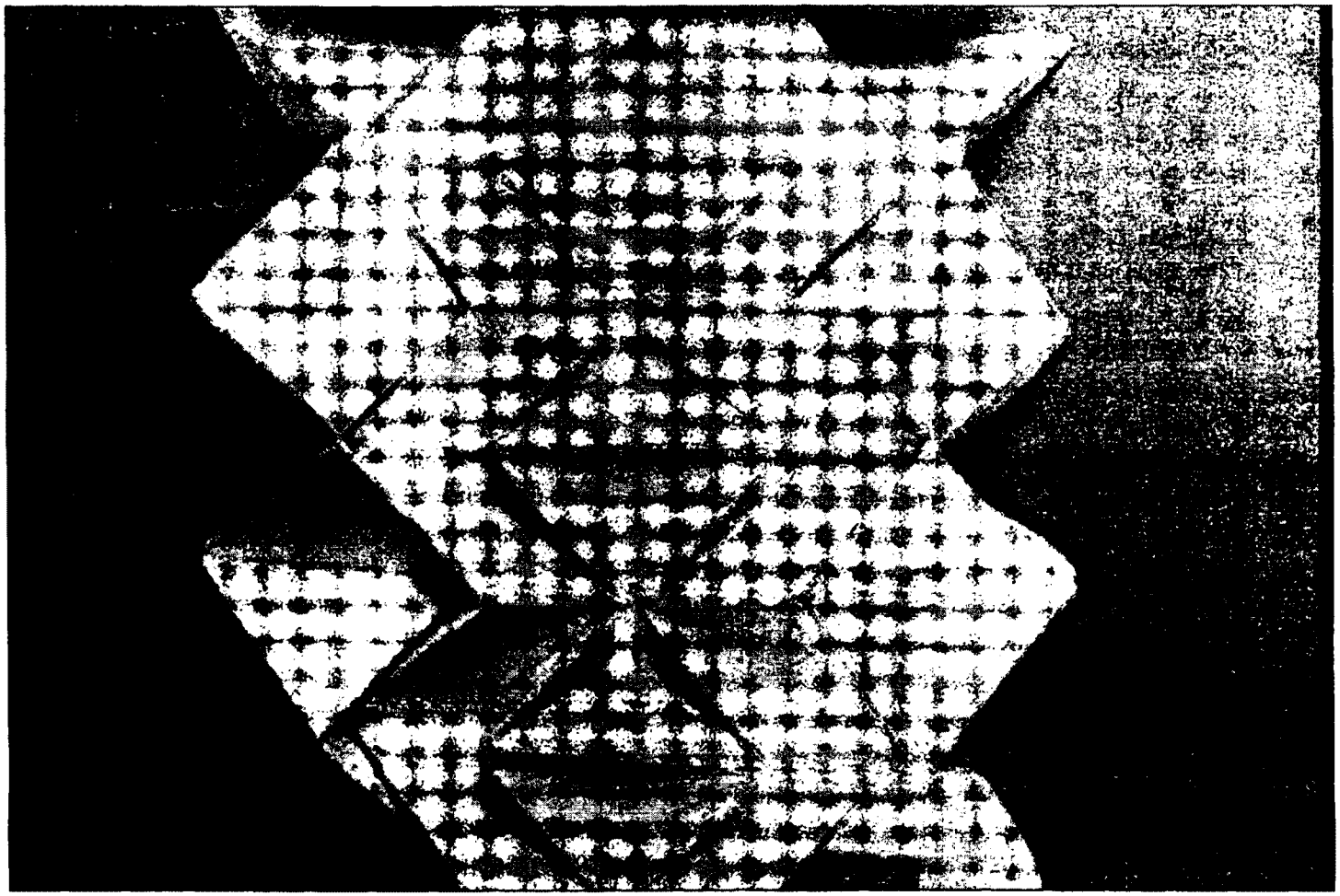
Figure 18:
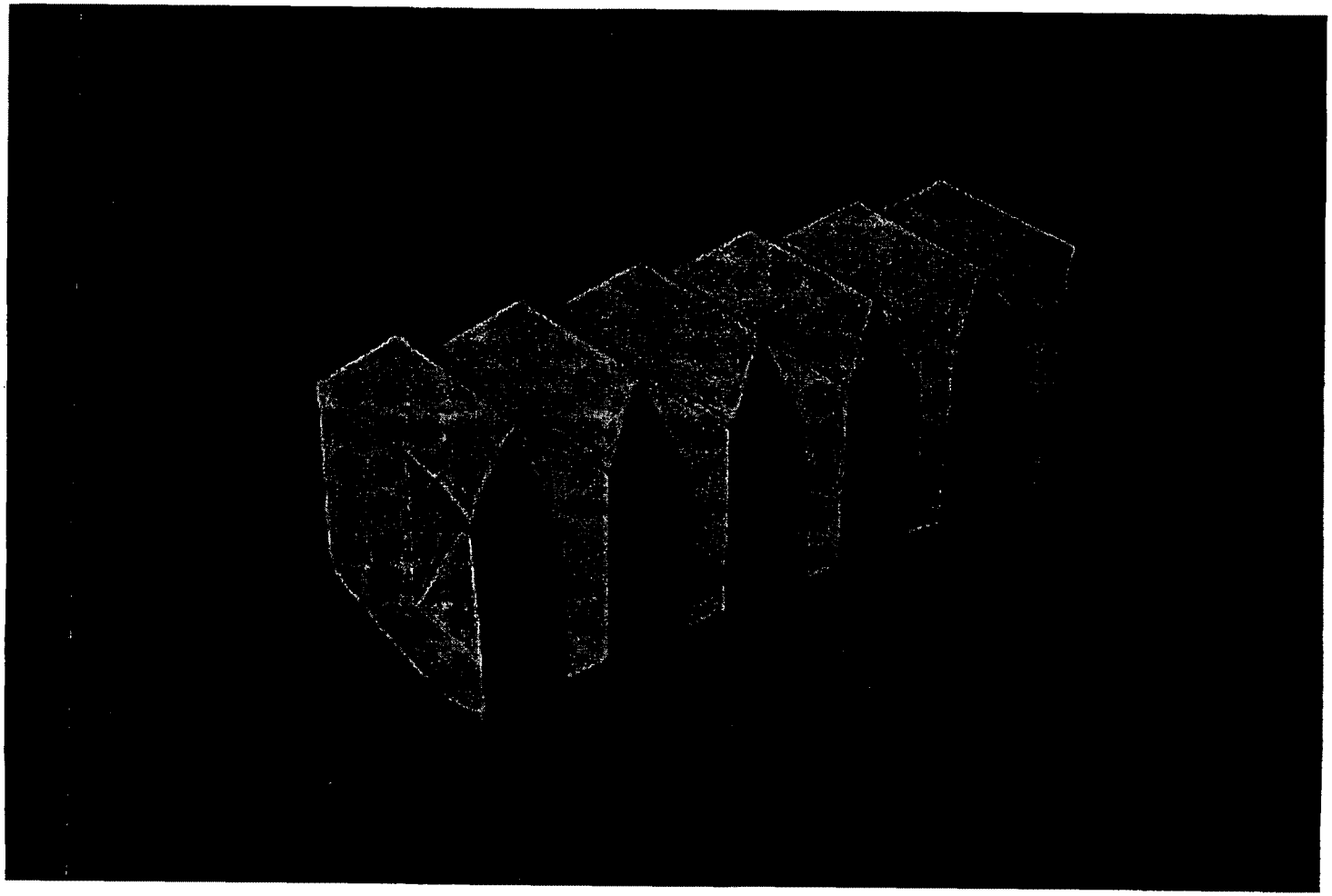
Figure 19:
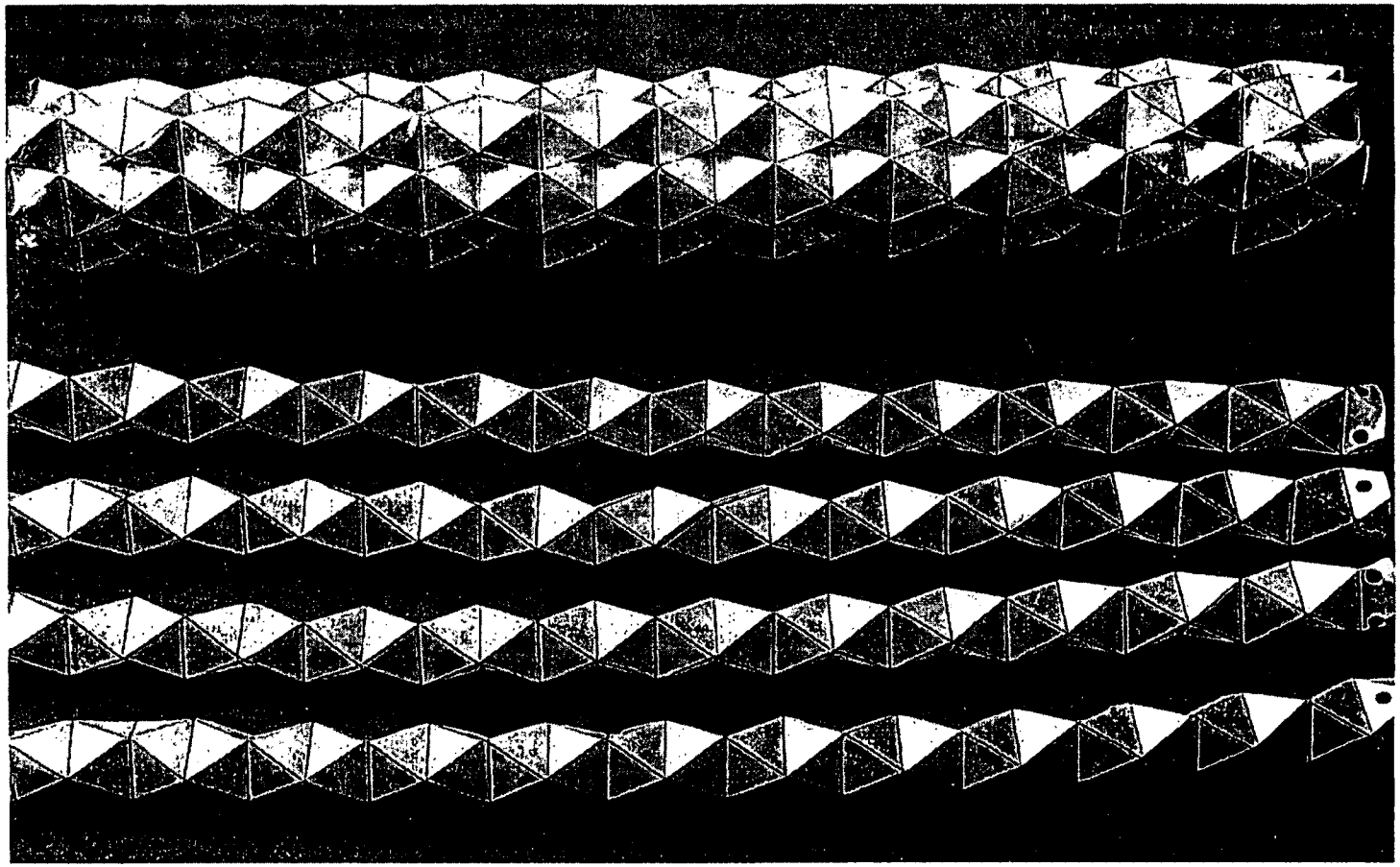
Figure 20:
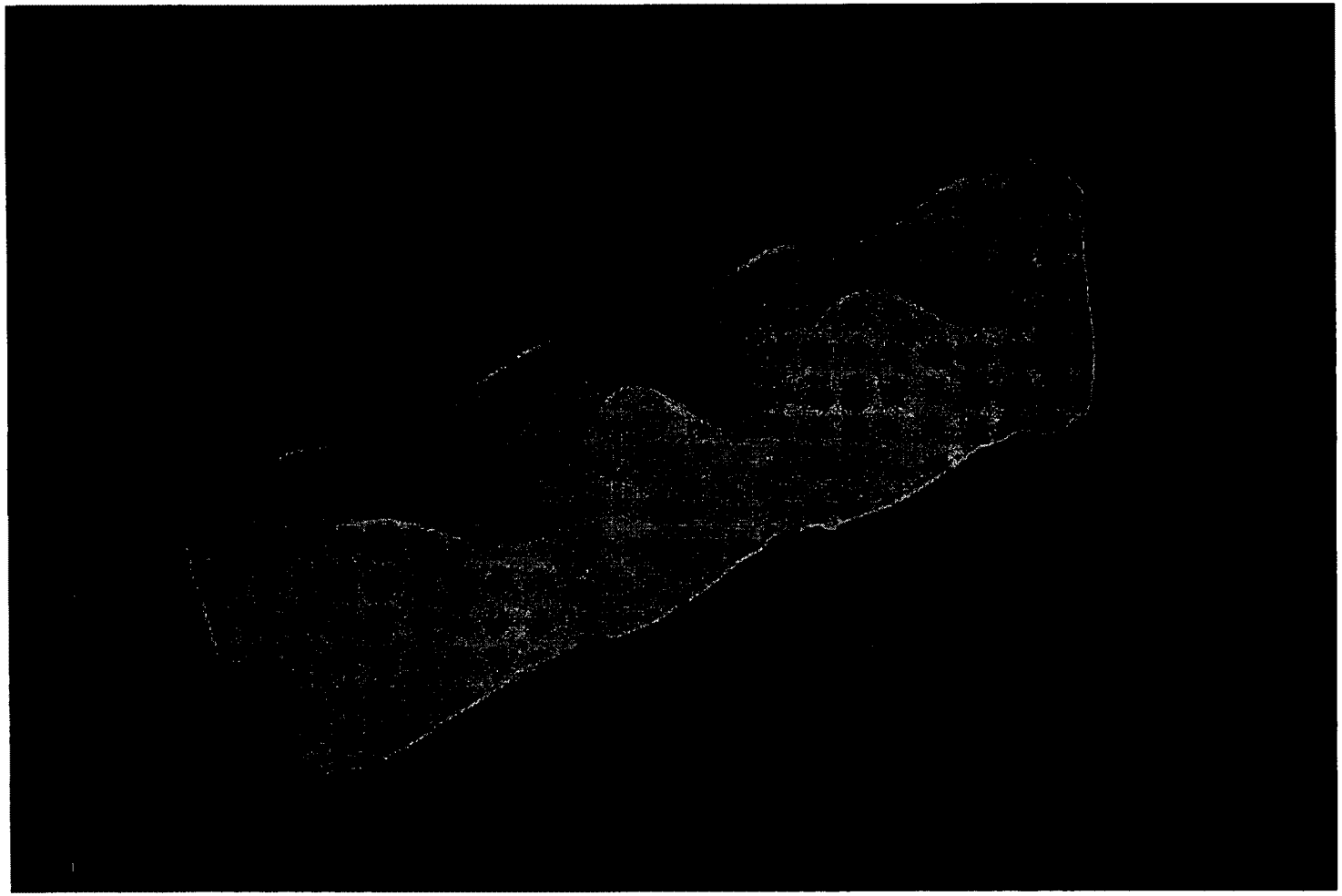
Figure 21:
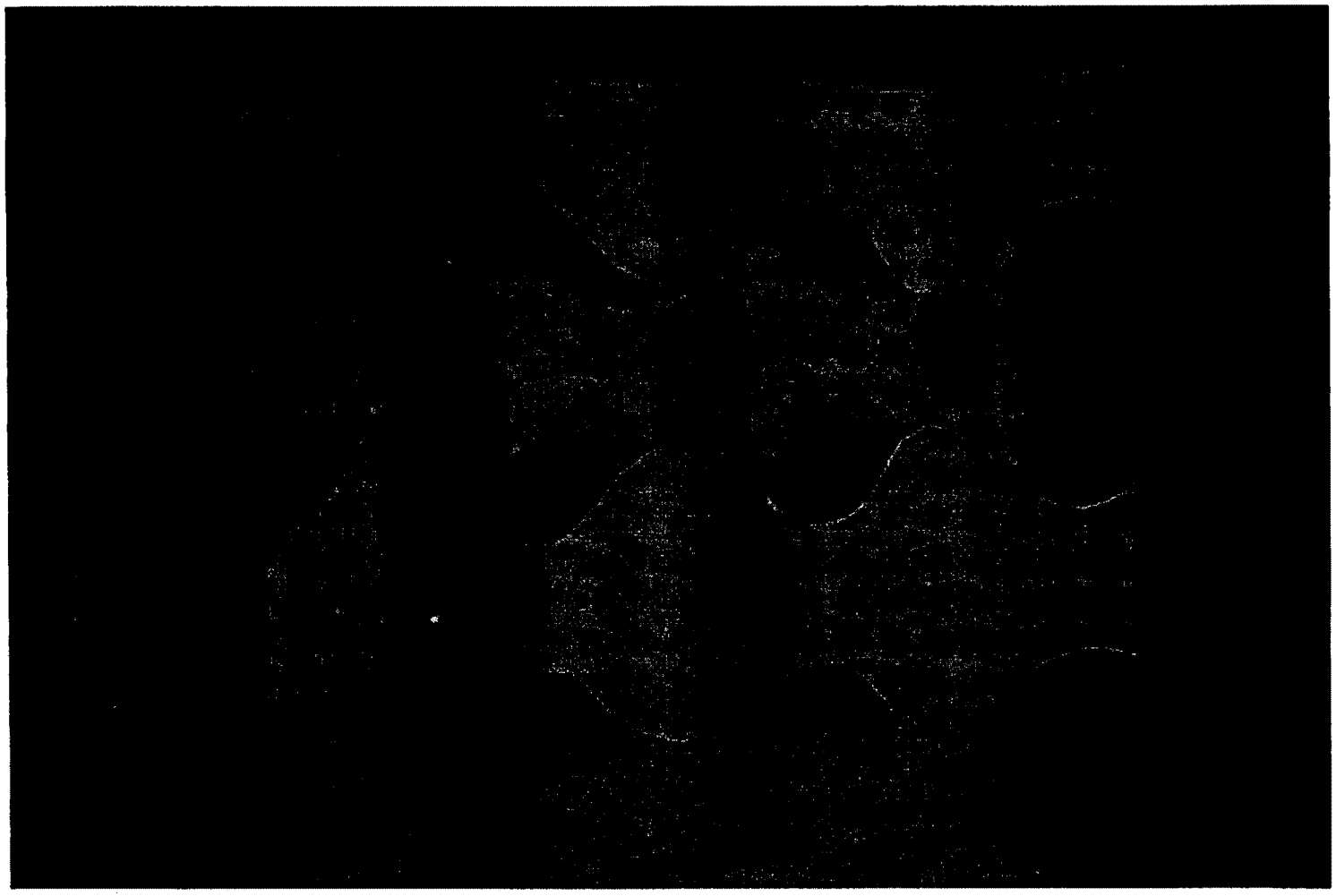
Figure 22:
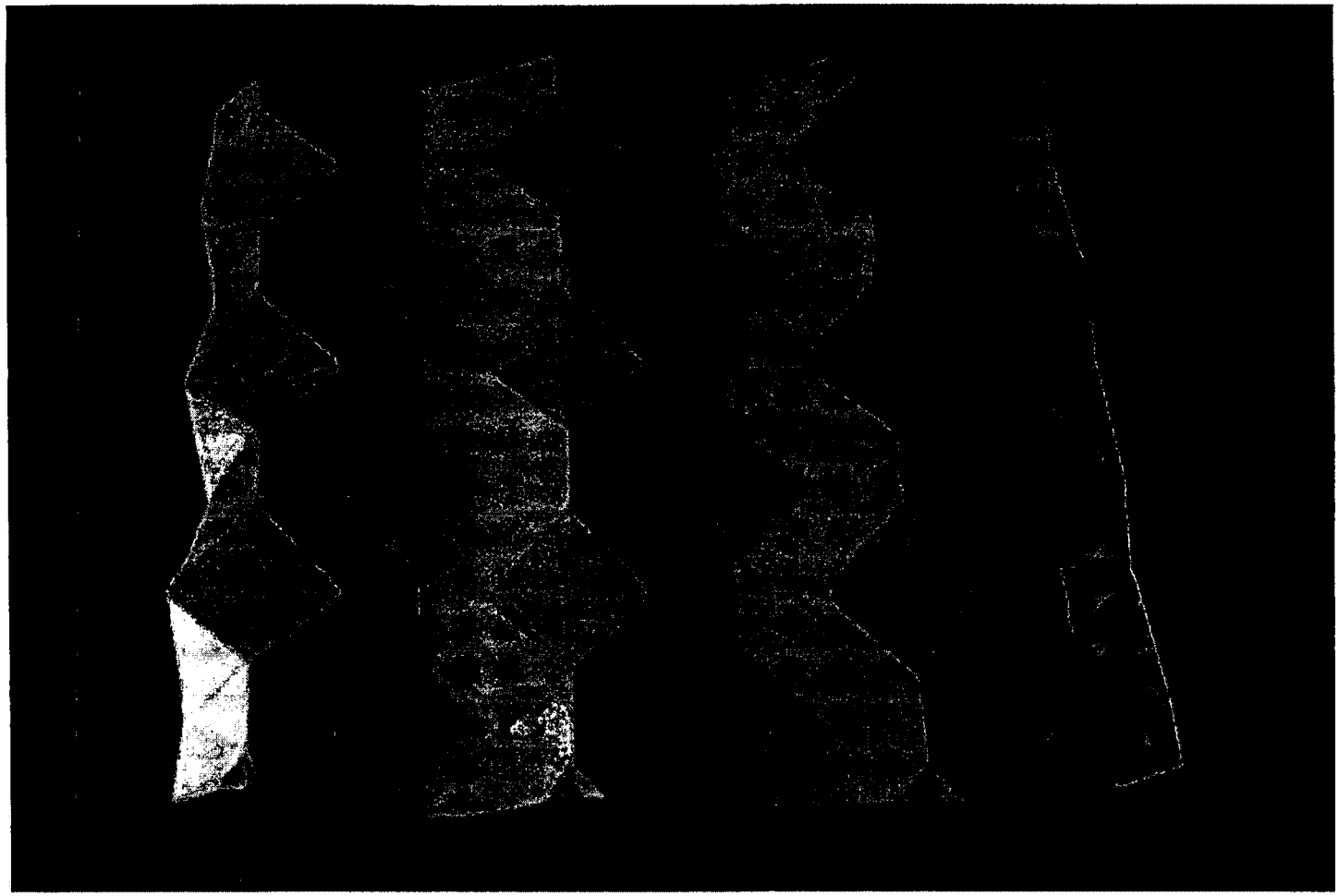
Figure 23:
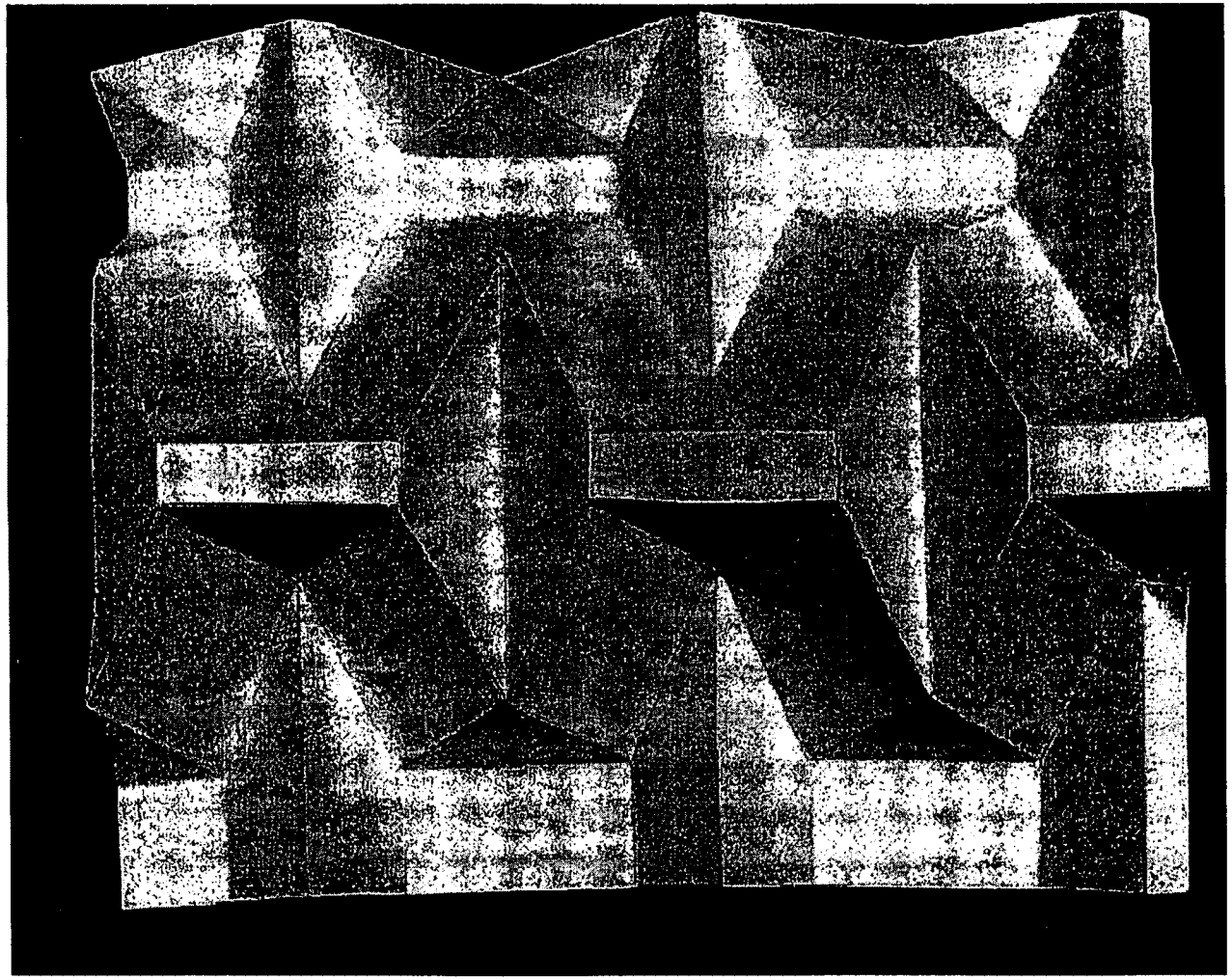
Figure 24:
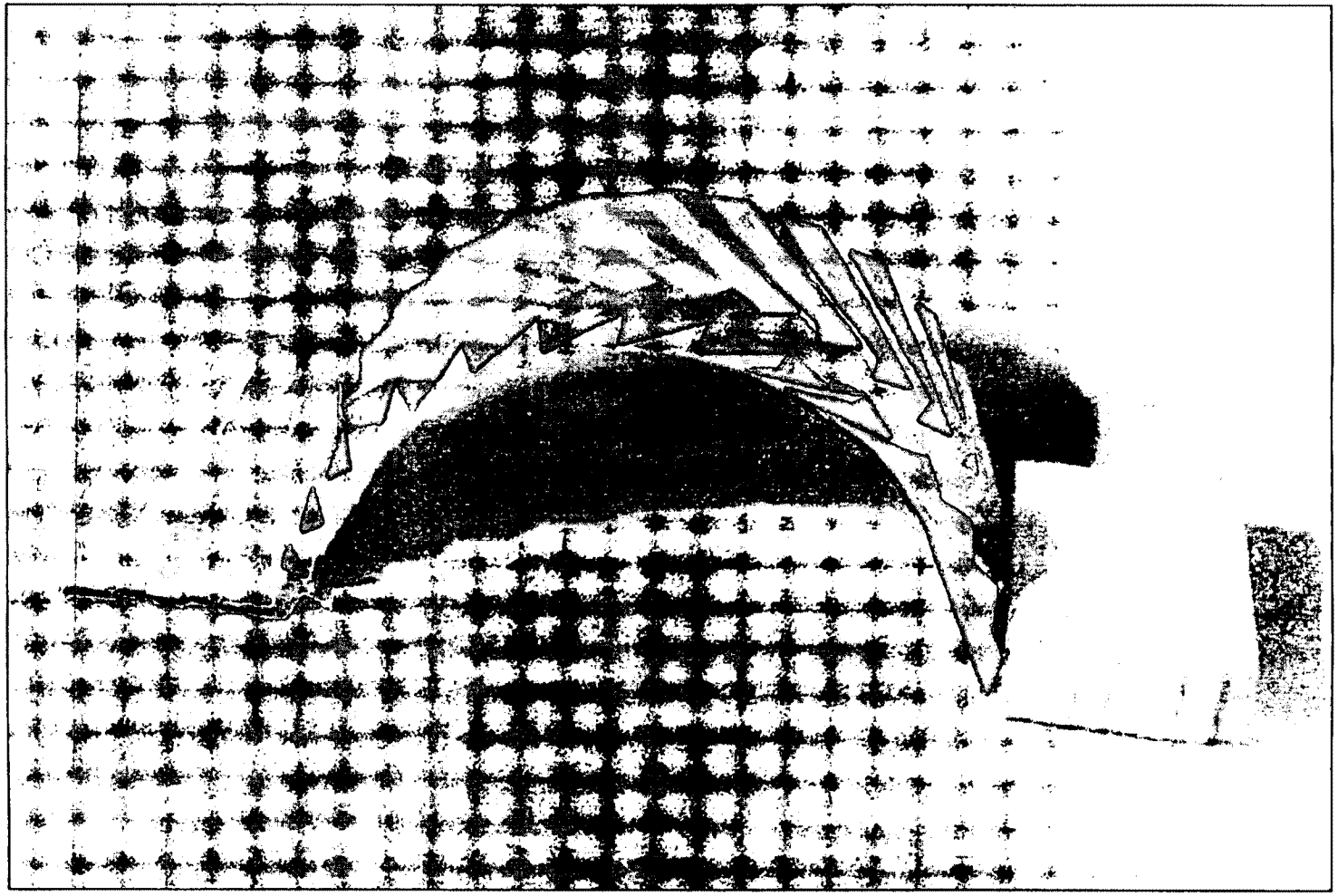
Figure 26:
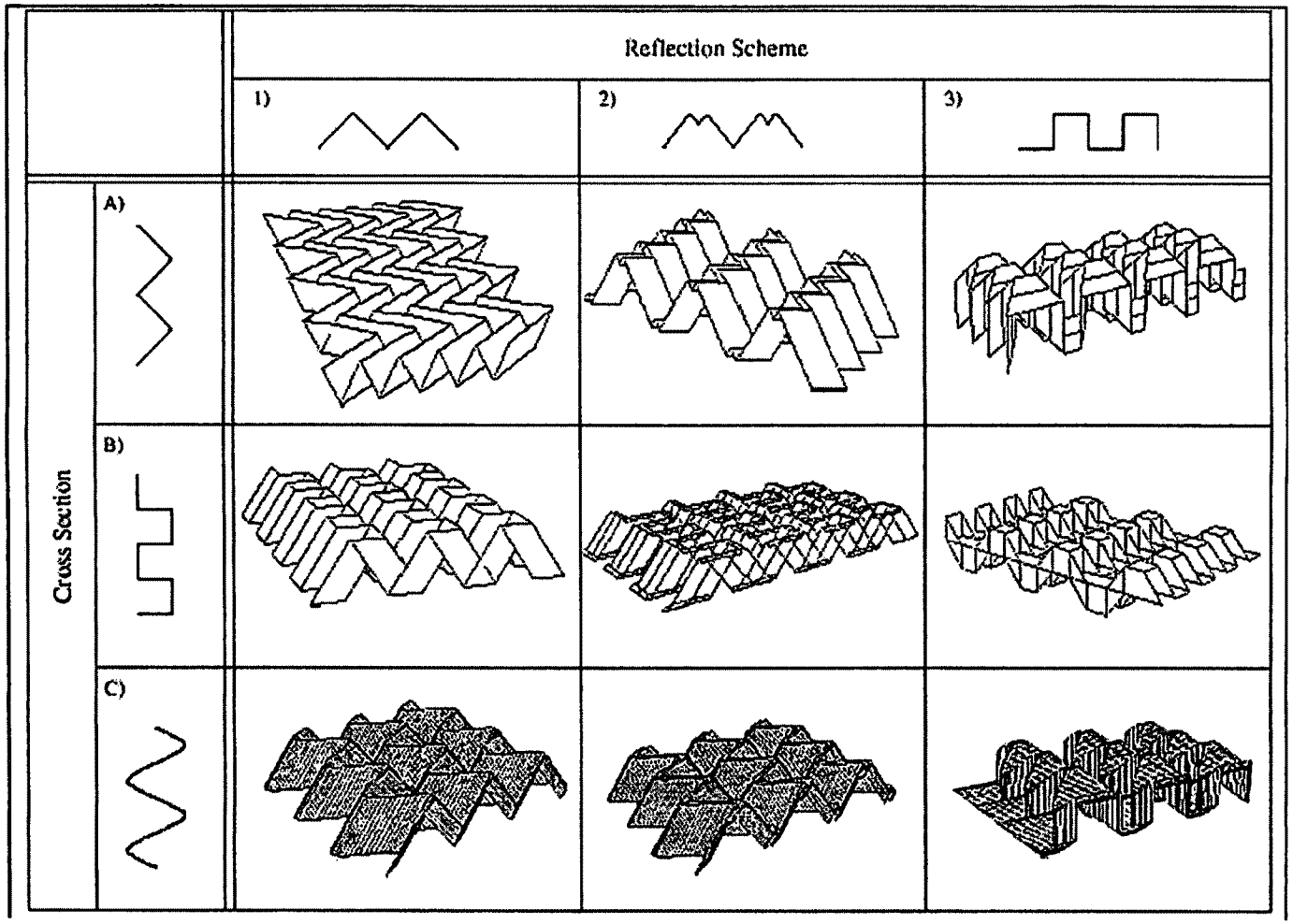
FIG. 26 shows cross sections, reflection schemes, and corresponding folding patterns.
Figure 27:
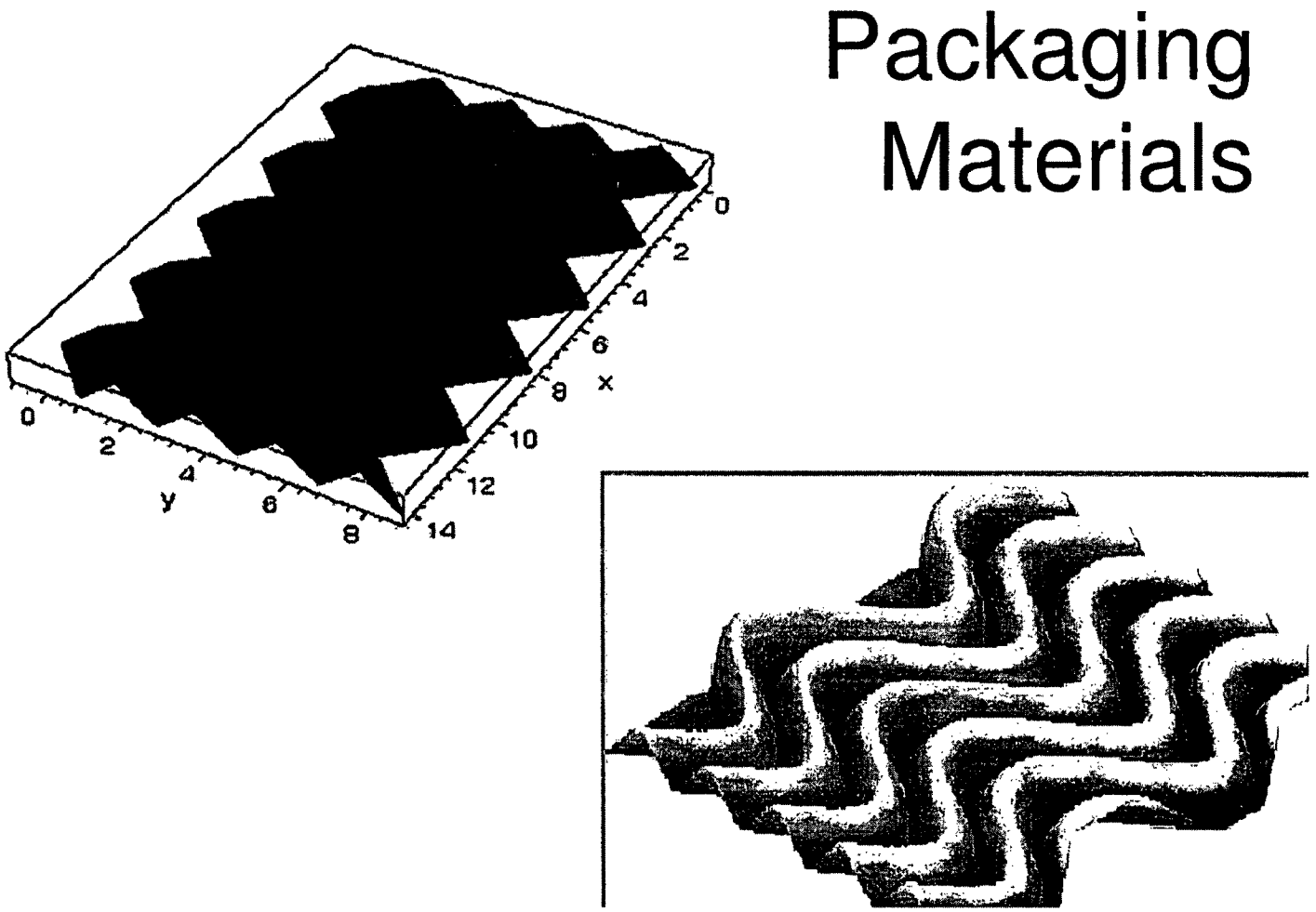
FIGS. 27-29 show embodiments folded structures and related applications.
Figure 28:
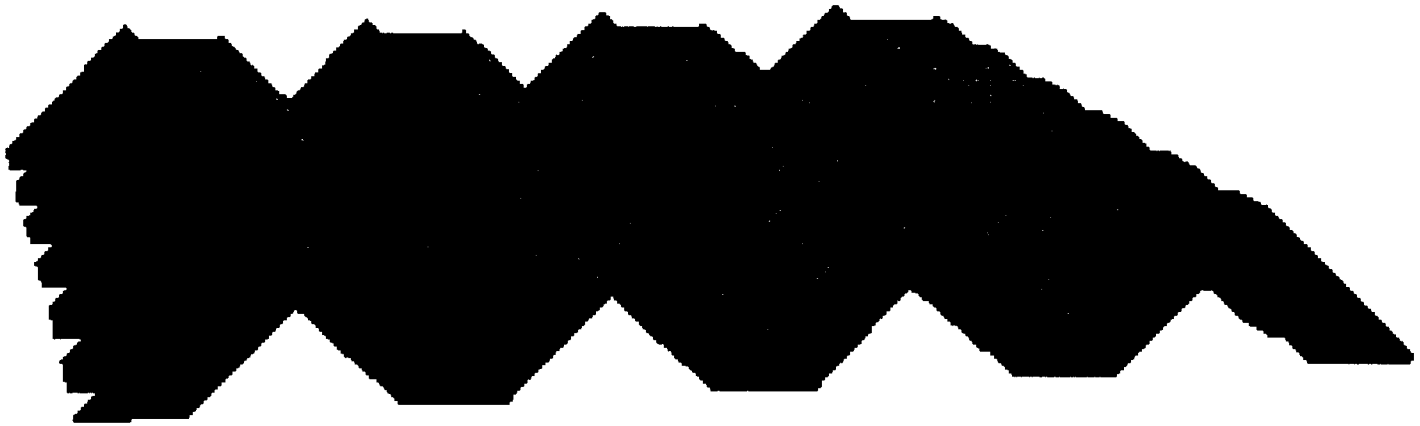
Figure 29:
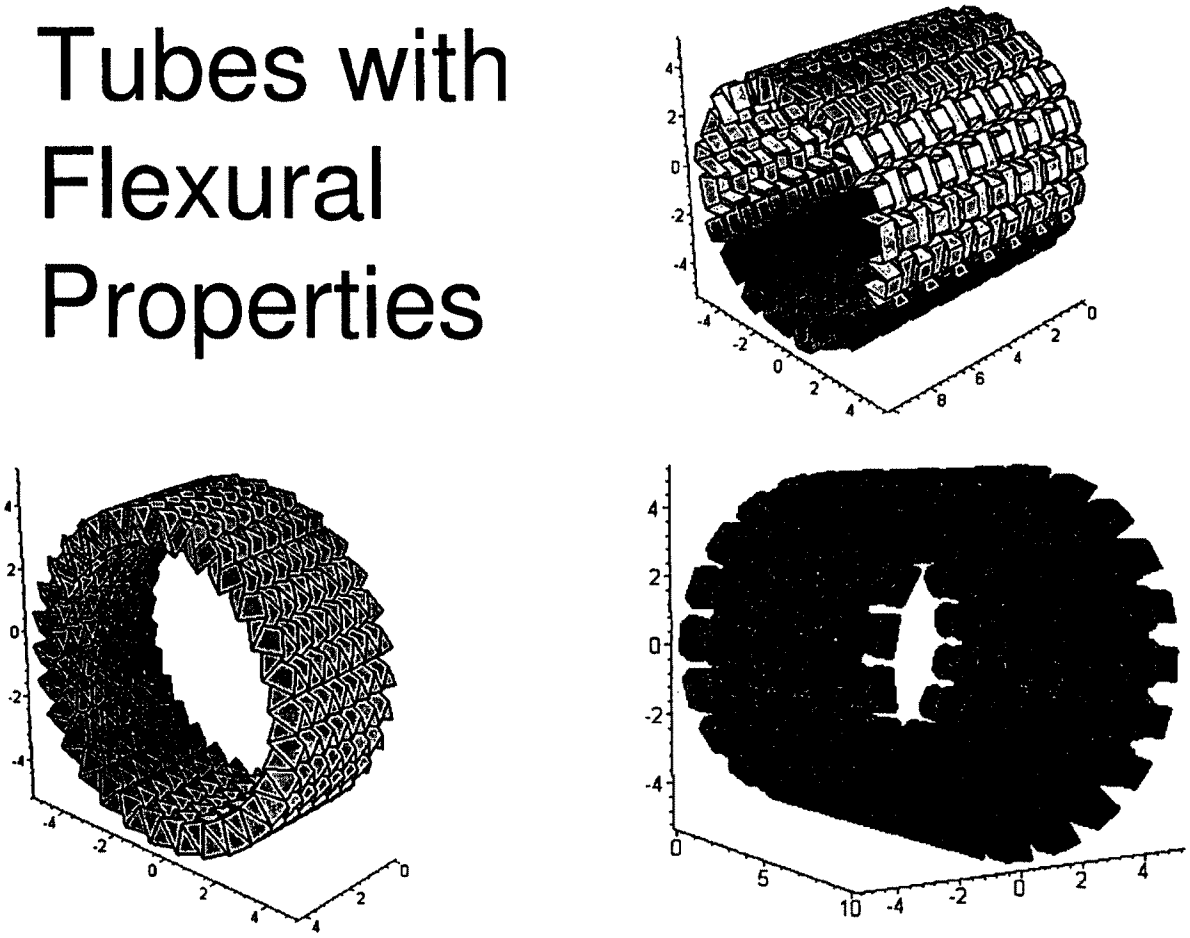
Figure 30:
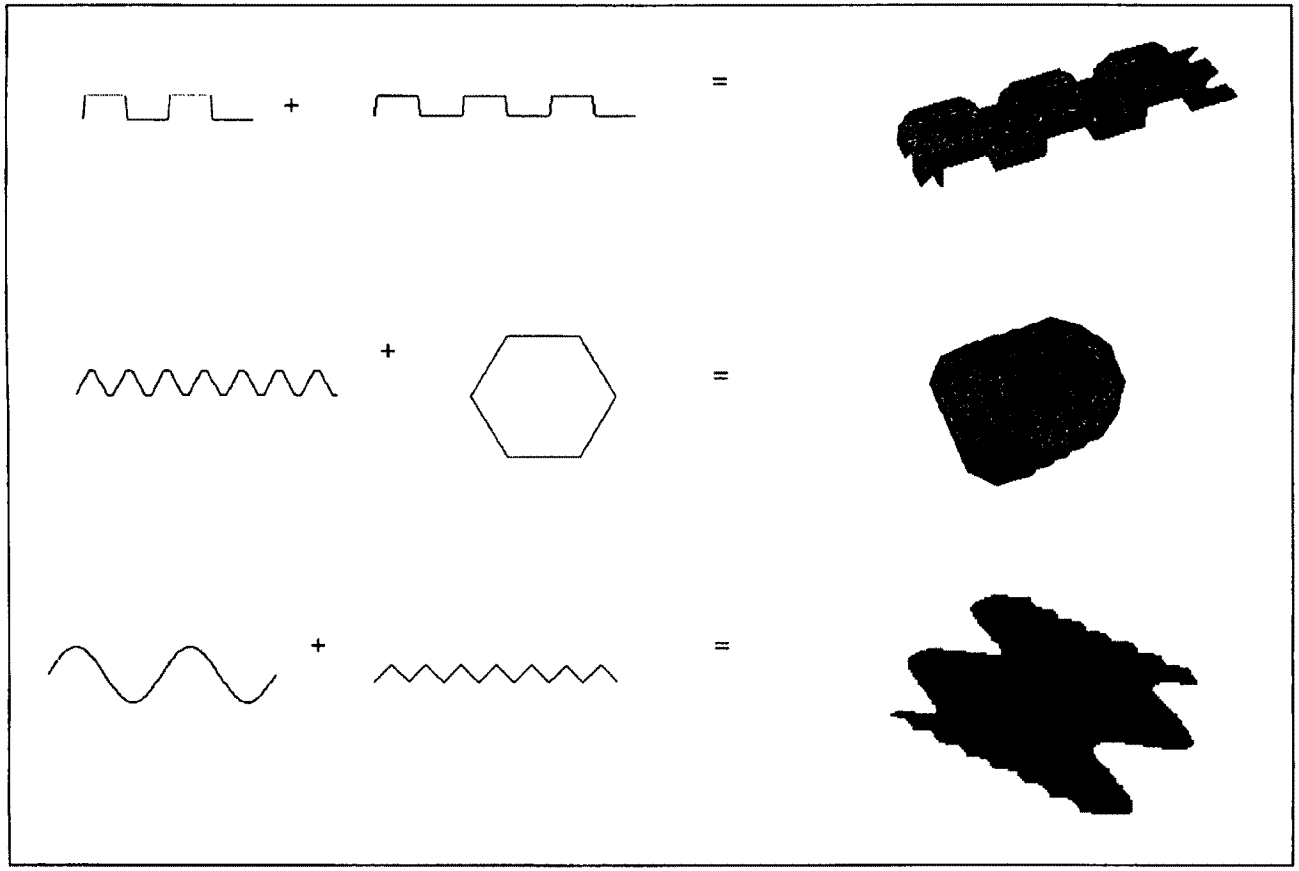
FIG. 30 illustrates direct and versatile software according to an embodiment of the present invention.
Figure 31:
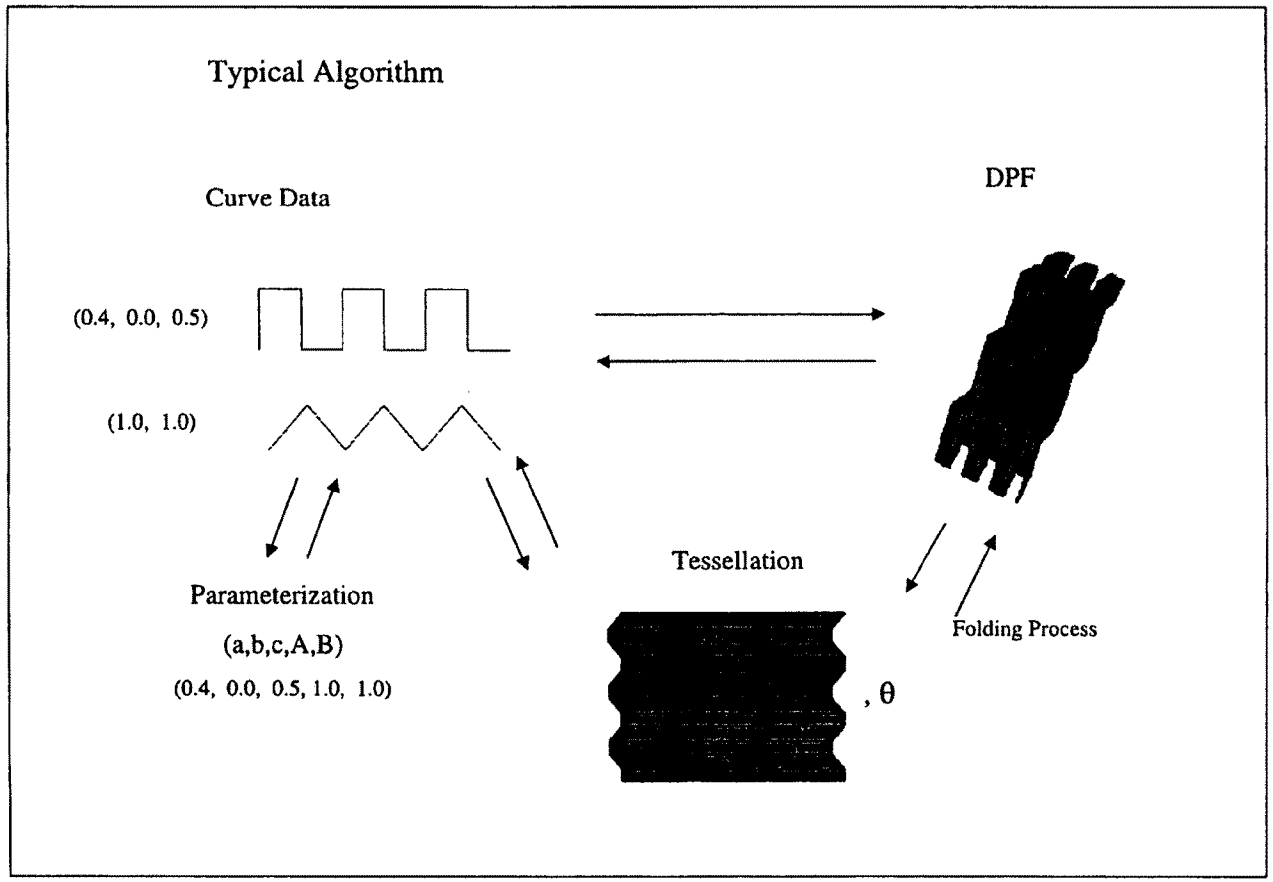
FIG. 31 shows curve data correspondences according to an embodiment of the present invention.
Figure 33:
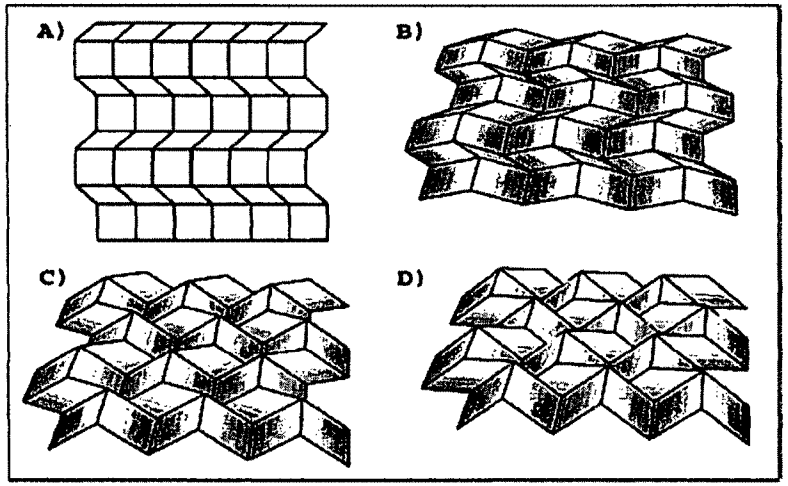
FIG. 33 illustrates a discrete parts manufacturing concept.
Figure 34:
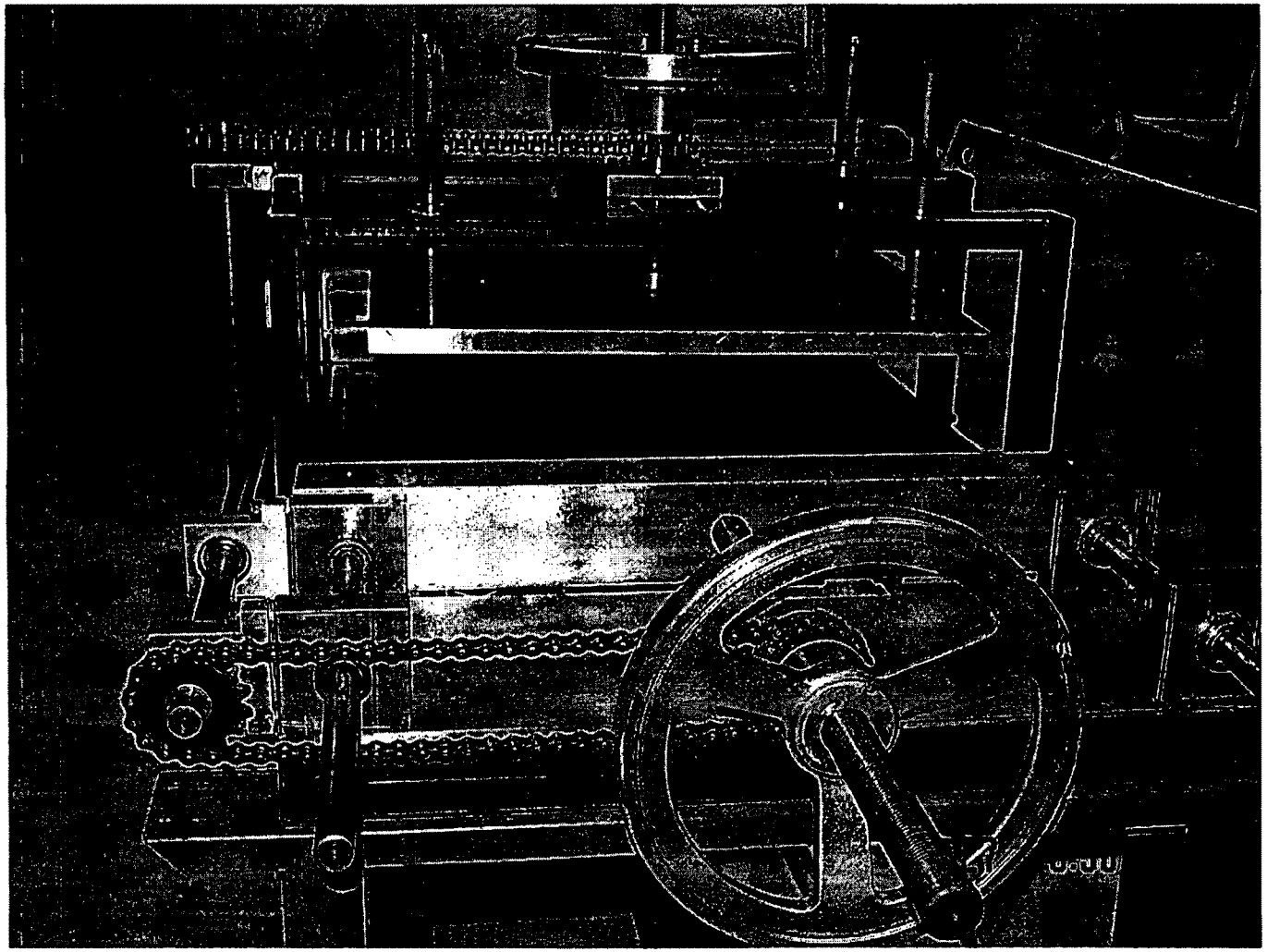
FIG. 34 shows a discrete parts machine.
Figure 35:
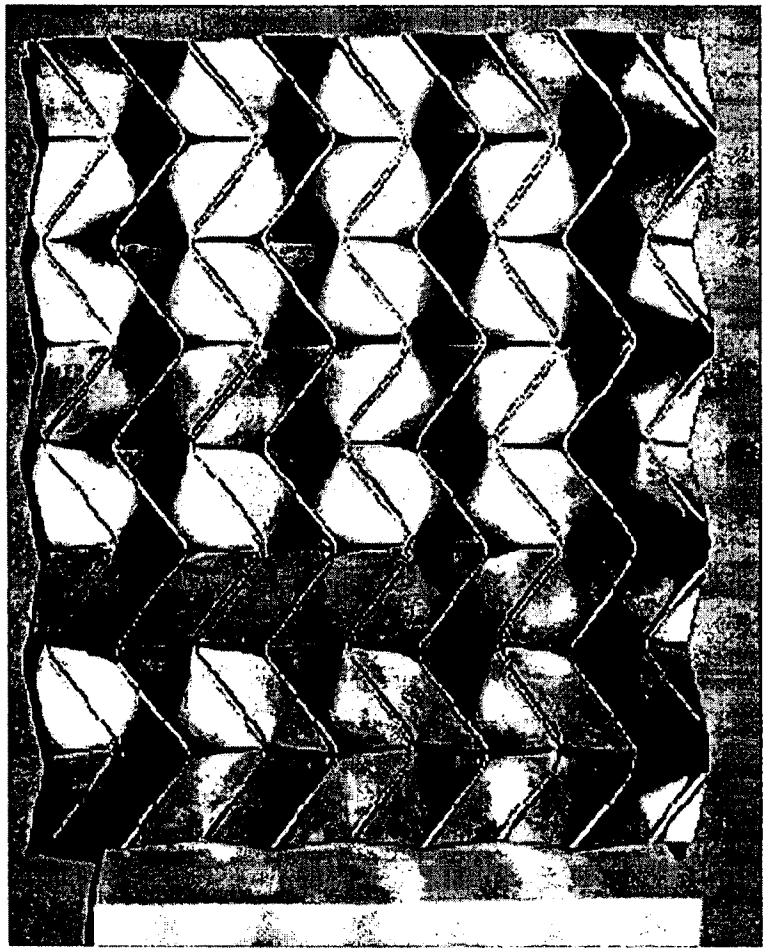
FIG. 35 shows folded galvanized steel.
Figure 36:
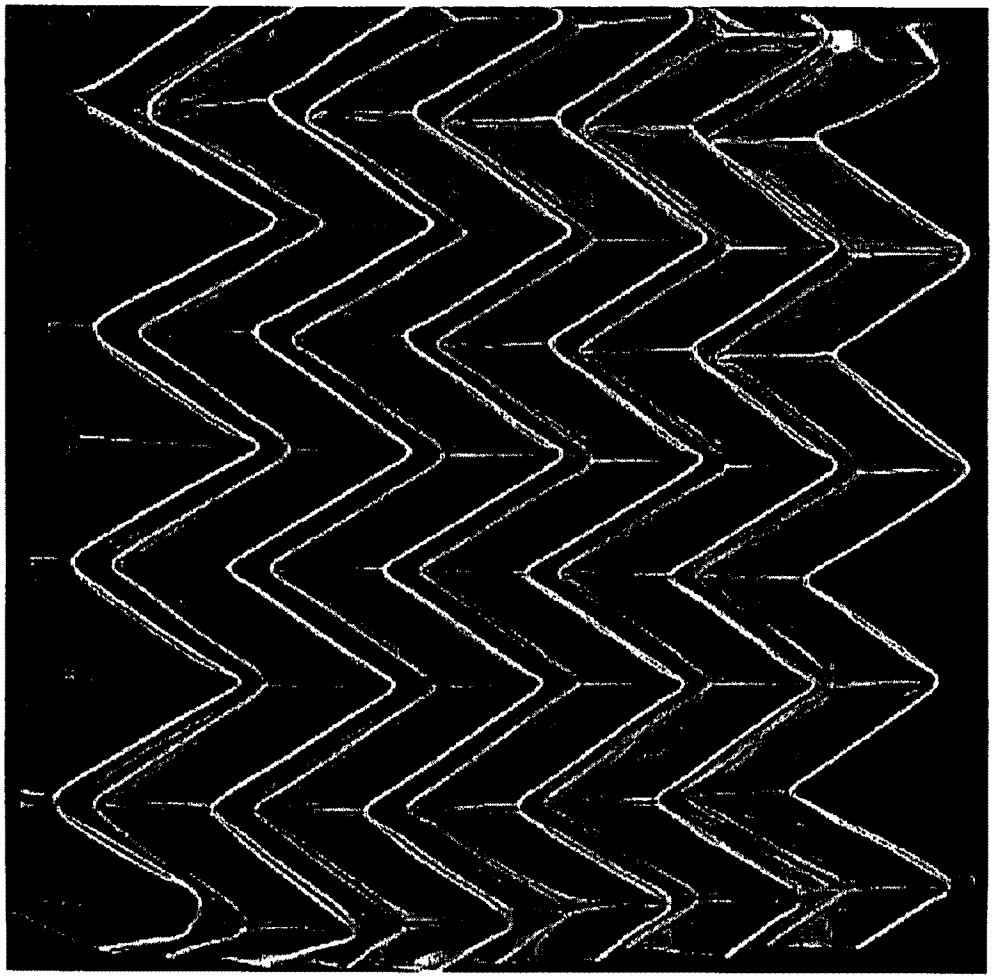
FIG. 36 shows folded copper.
Figure 37:
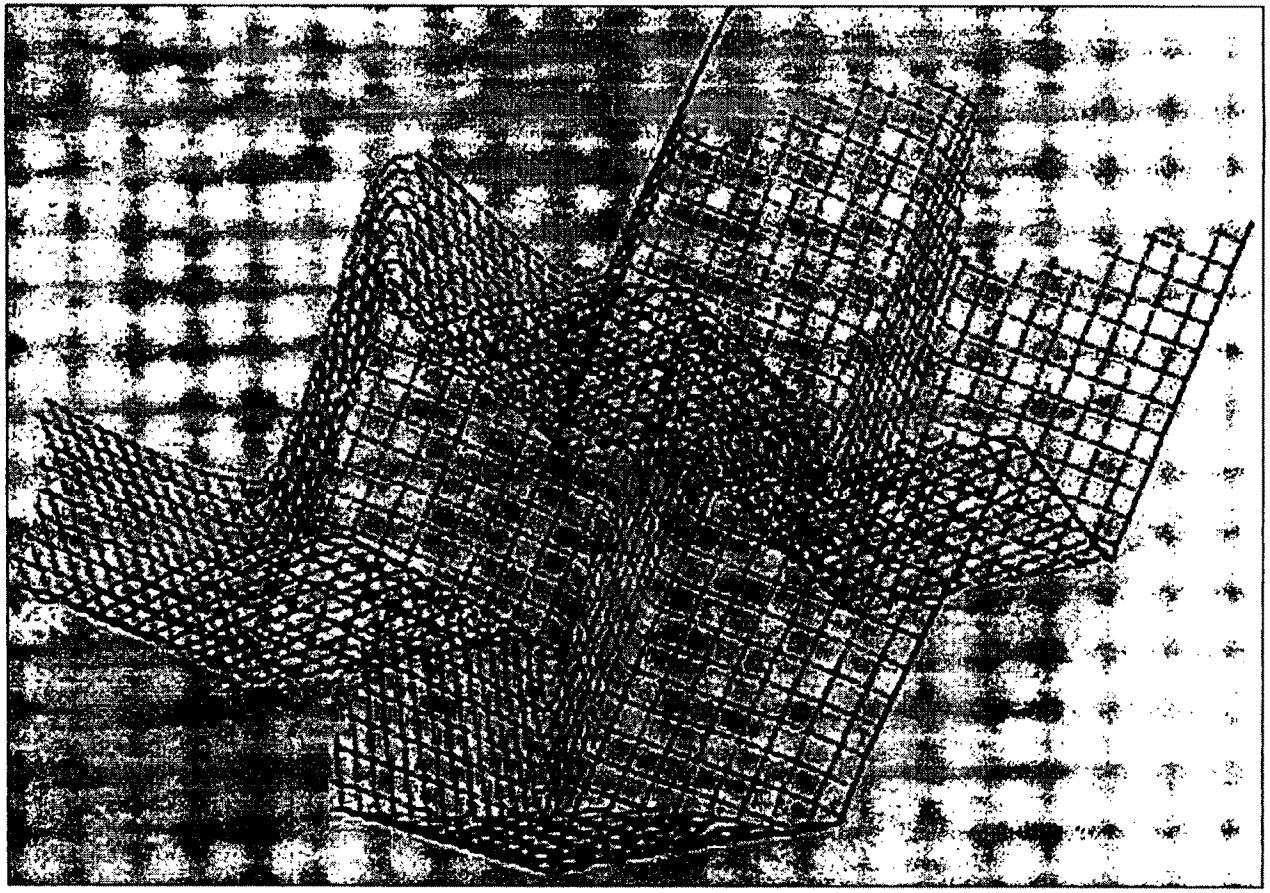
FIG. 37 shows a folded wire mesh.
Figure 38:
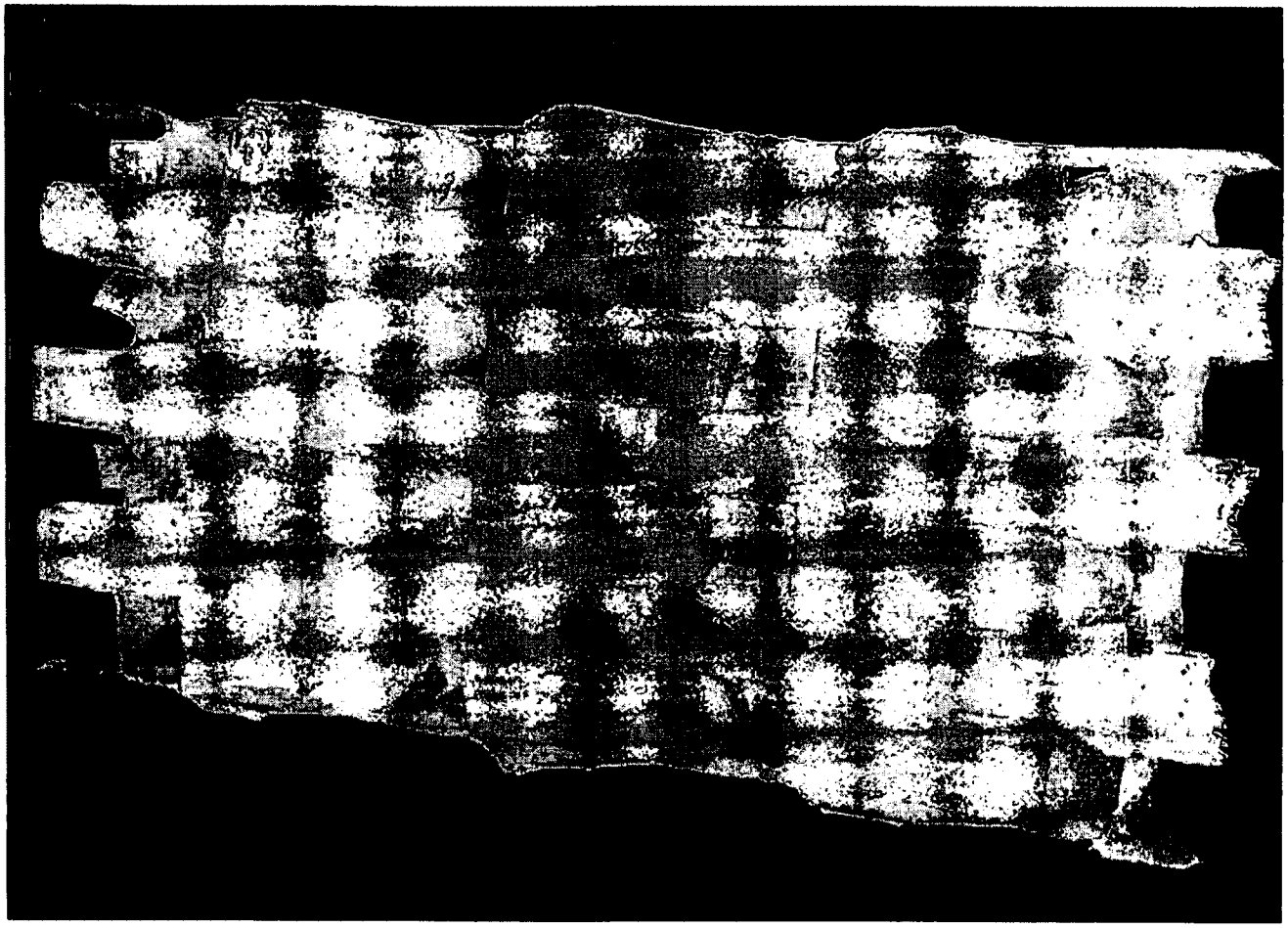
FIG. 38 shows a folded epoxy-fiberglass composite.
Figure 39:
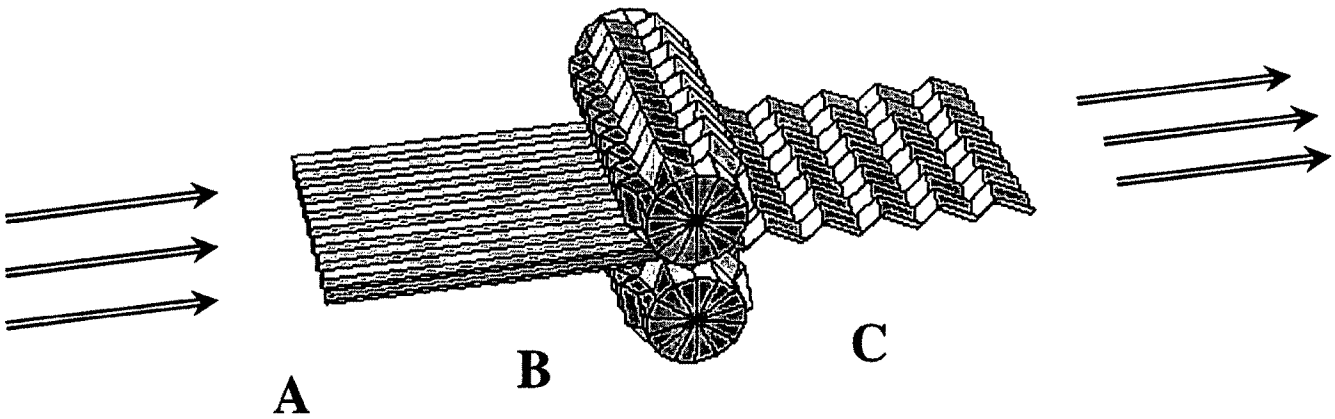
FIG. 39 illustrates an embodiment continuous manufacturing process.
Figure 40:
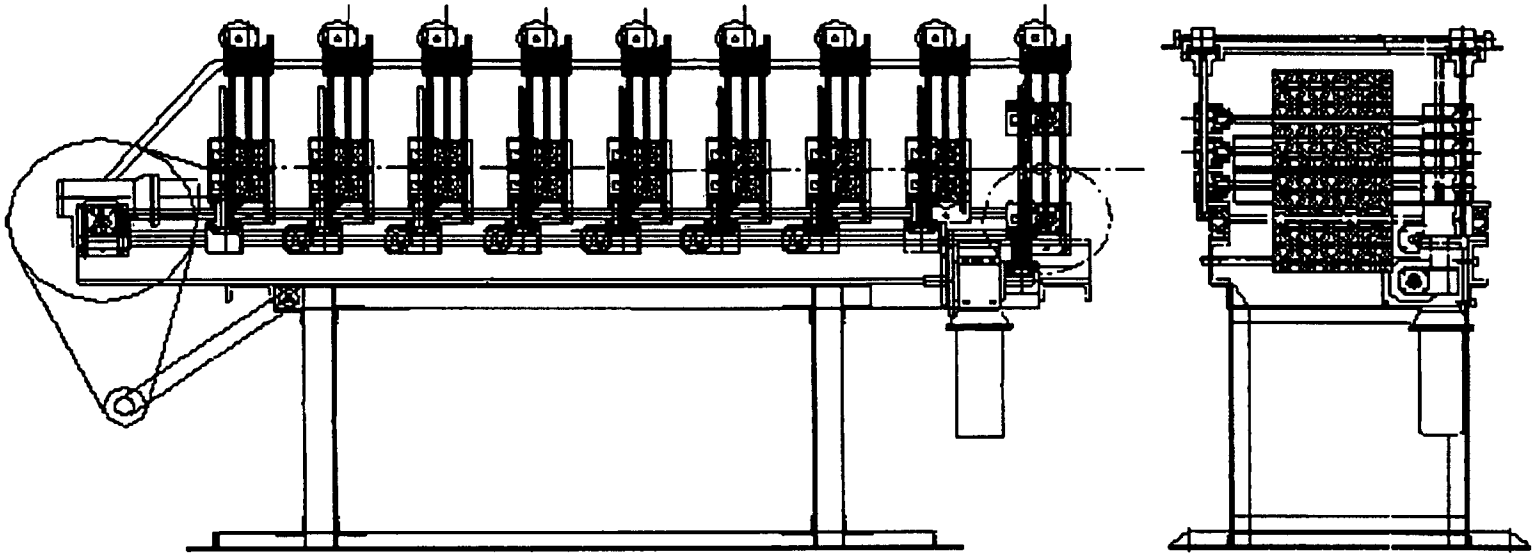
FIG. 40 illustrates an embodiment folding machine.
Figure 41:
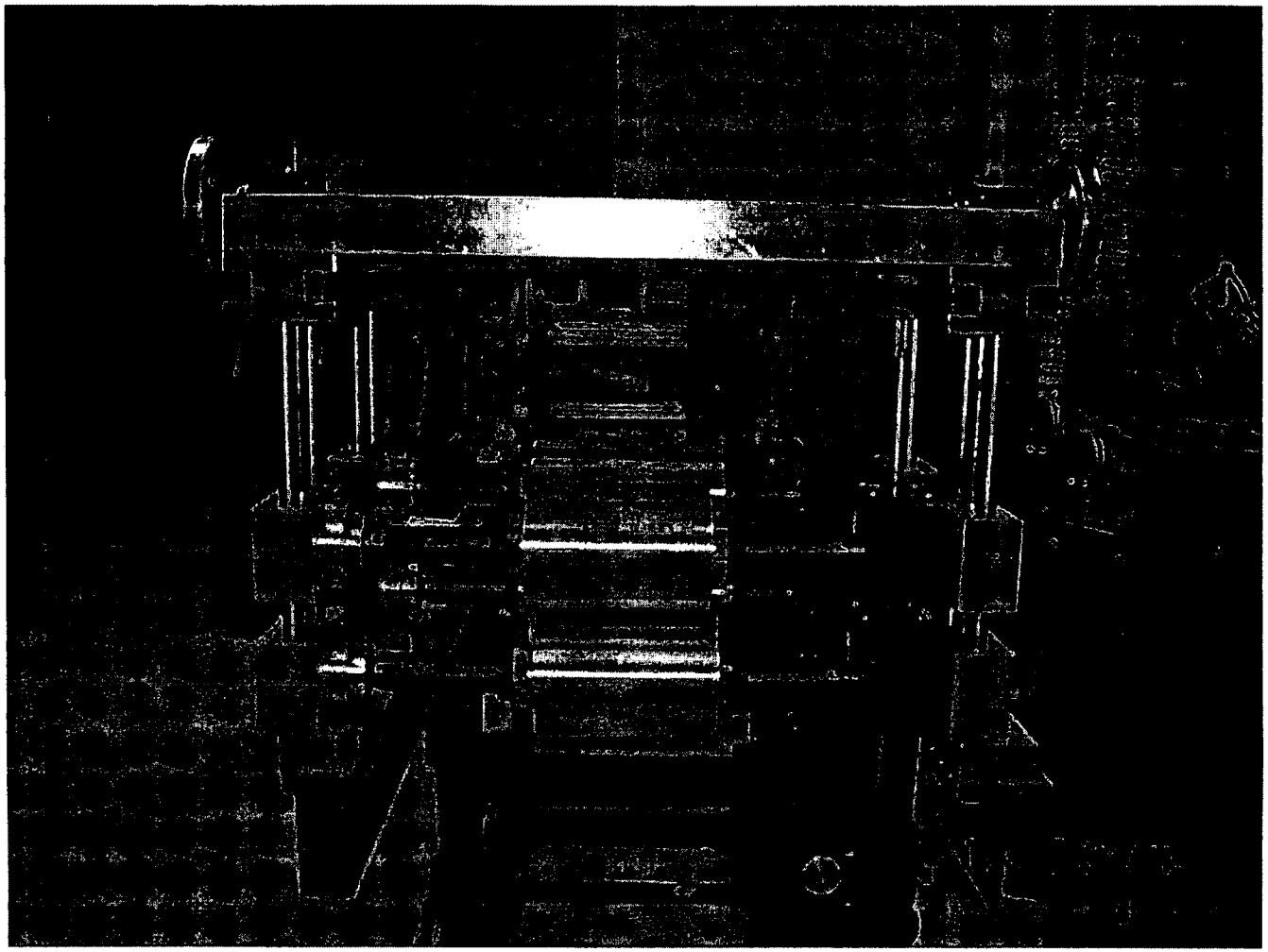
FIG. 41 is a photograph of an embodiment folding machine.
Figure 45:
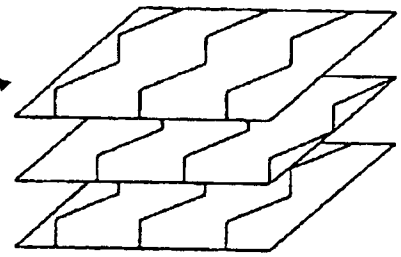
FIG. 45 illustrates an embodiment multi-laminate actuating method.
Figure 46:
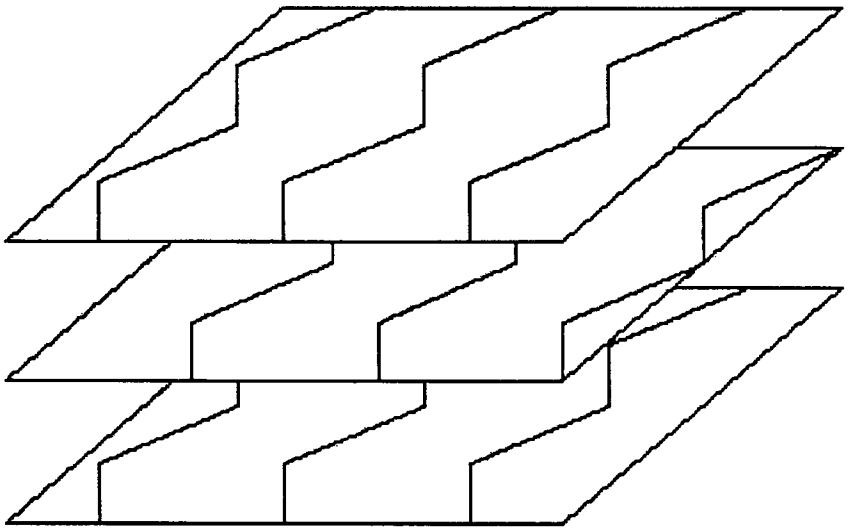
FIG. 46 illustrates a embodiment multi-laminate expanding method.
Figure 47:
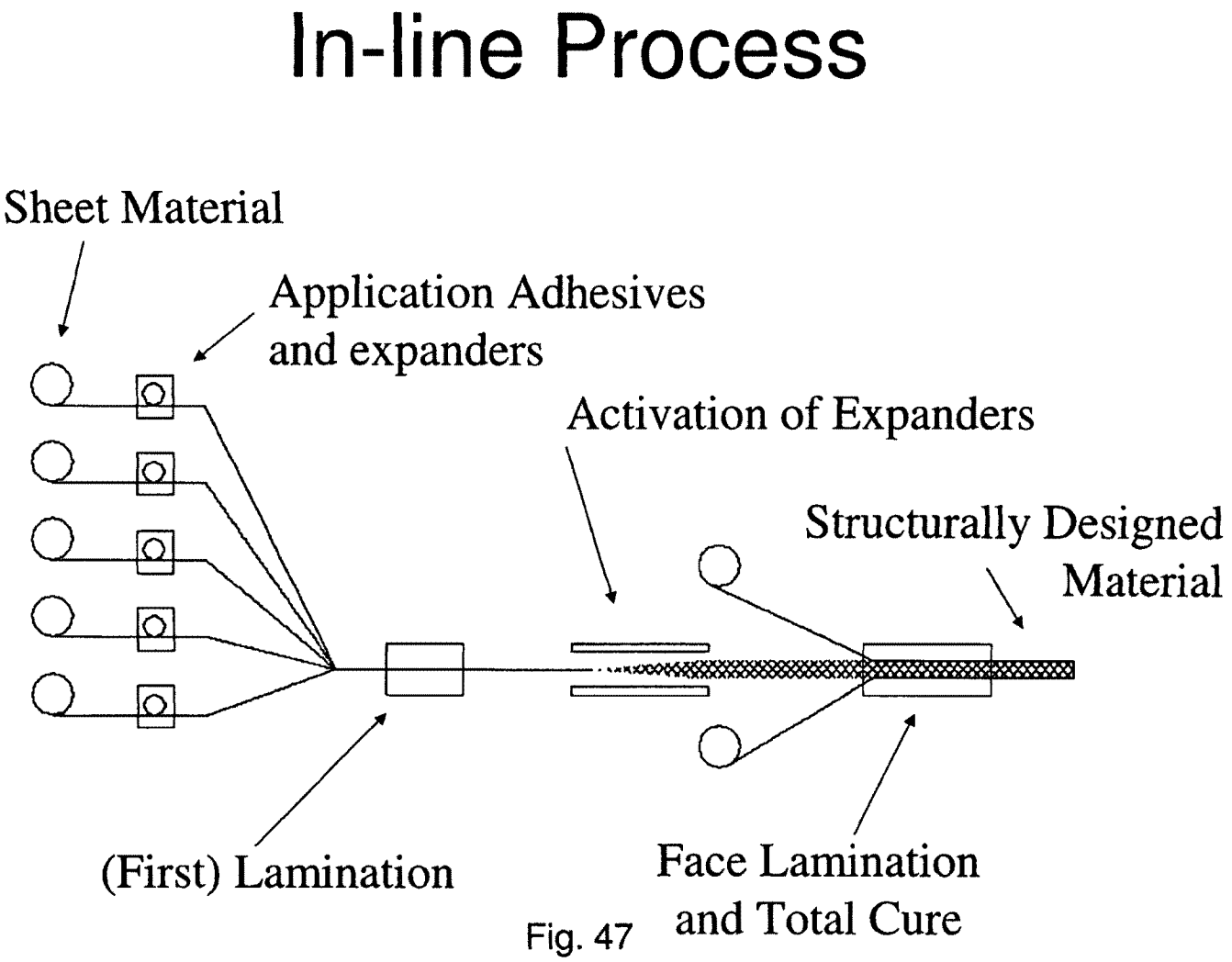
FIG. 47 illustrates an embodiment in-line process.
Figure 49:
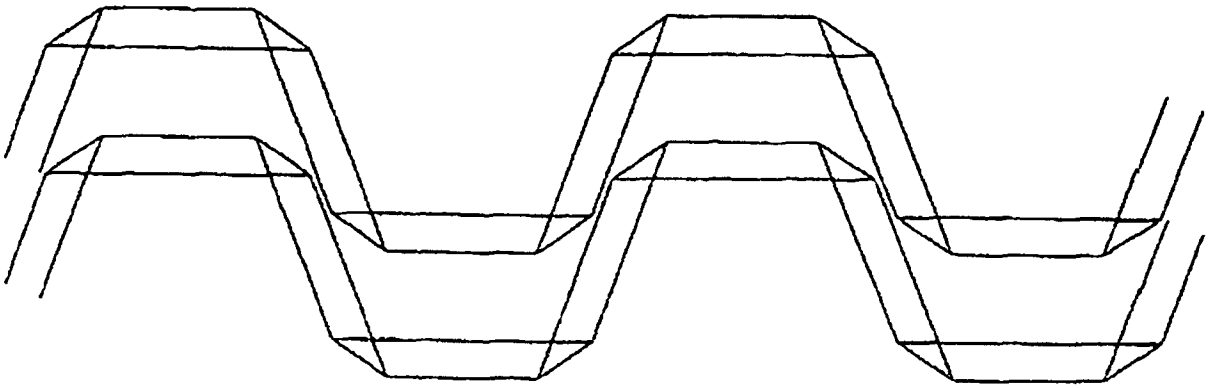
FIG. 49 illustrates vertical face-to-face gluing areas.
Figure 50:
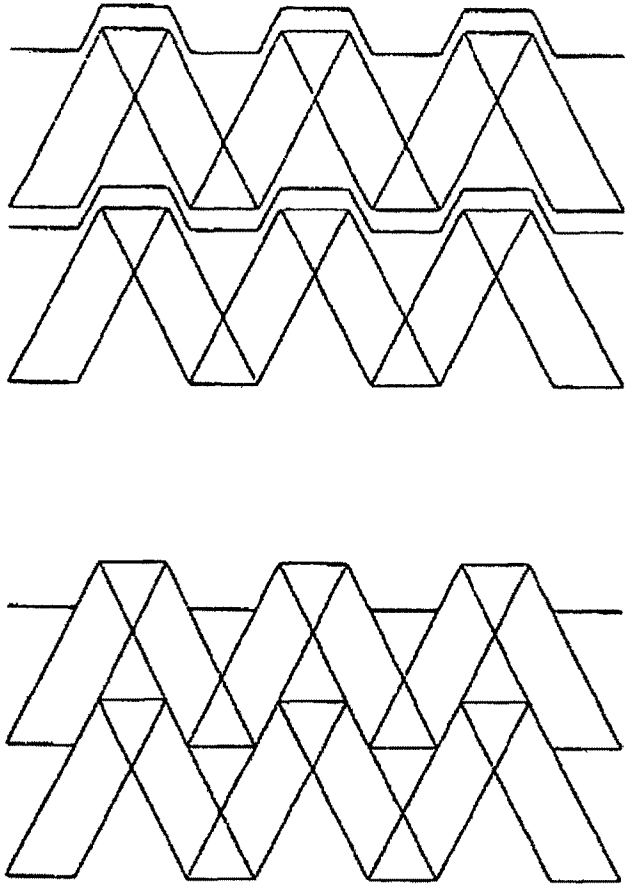
FIG. 50 shows a stripmap/conventional-corrugation-cross-section sequence before and after assembling layers together.

For a continuous forming process for planer sheets (FIG. 7), several sheets may be printed in line and converge in flow for lamination. The process continuous through an activation area, including possible inferred or microwaves heat. The agents in the laminate may steam, foam, release vapors, etc and cause the thickness to expand. The material may continue to advance into a low-pressure region to facilitate the conversion from the flattened lamination to the 3D structure. A smooth face sheet may be added to each side. The material may then be heated to a higher temperature or otherwise activated if desired, to cure compounds in the sheet layers for an added strength and monolithic fusing of the sheets' polymers, resins, ceramics, etc.

X. Method of Producing Surfaces with Specific Curvatures and Photographic Relief Images.

This is a method for rapid prototyping and general manufacture of surfaces with specified curvature. Sheet material with directional and variable shrinking (or expanding) factors is used. For example, the conventional shrink wrap with non-shrinking fibers added in one direction would suffice. Preferably a printed application to the sheet effects the shrinking constant continuously. In one embodiment at two different "inks" effect mutually orthogonal directions substantially differently, so that one may print the two "inks" in various amounts to obtain custom control of the shrinking locally in each direction. It is also preferred that three "inks" effect mutually 120 degree directions substantially differently, so that one may print the three "inks" in various amounts to obtain custom control of the shrinking and shear locally in each direction. In these systems it is preferred the ink does not effect the shrinkage until activated, as by heat or other agent. Also preferred is the material be generally elastic, to enable resolution of contrasting contraction parameters.

One or preferably more sheets are printed. If the sheets contract in only one direction, pairs of sheets may be laminated together at 90 degree or other angles. The sheets are stacked and laminated, with optional passive spacing layers in between. The lamination is heated uniformly or otherwise activated, the relative shrinking (or expanding) coefficients in various directions produce the contoured surface.

Many fibers contract when exposed to different solvents. The "inks" could be these solvents, catalysts or inhibiting agents. Cloths with two or three different type fibers in orthogonal directions could be used. Alternatively stretched fibers, embedded in a hardened mix could be employed. Two or three different hardened mixes may be used on each of the fiber directions. The "inks" slightly dissolve the hardened mixes, causing the fibers to release their potential energy and shrink. Alternatively a sheet or cloth could be stretched, fibers of two or three types laminated in their respective directions. Softening these fibers differentially would give control of the contraction and cause the shaping of the surface.

The general quality is that by applying "inks" in varying amounts they sheet will contract in respective directions dependently on the ink quantities, causing controlled contraction locally. This induces curvature, which if multiple layers are employed with optional spacing layers, is enhanced dramatically by the relative contraction ratios of the multiple layers.

An application produces relief photographs. The three-dimensional data may be recorded by stereo-graphic techniques. The printing process may be carried out on a backing laminate to generate the curvature, and an elastic printing paper on the top layer receives the color. The sheet is processed into a 3D relief color image.

Calculations may be done by triangulating the relief surface, mathematically stretching the triangulation to lie flat in a plane, calculating the relative amounts and proportions of "ink" agents needed to contract the plane triangulation back to the relief surface, and coloring the top layer on the flat multi-laminate so that the points on the plane with their contraction effects correspond to the colors and intensities of the respective points on the relief surface. Other methods for calculation are possible.

XI. Multi-Laminate Materials Continued

Much has been described above about the design, manufacture and application of multi-laminate materials using my folding technology. Some additional description is given here that may be used in conjunction or independently from the earlier description. For multi-laminate materials it may be desirable for the core to resist delaminating. This may be accomplished by using a structure with somewhat or completely vertical face-to-face gluing areas. This is illustrated in the FIG. 51. Shown are stripmaps used to generate the DPFs of successive layers with preferably a row cross section similar to a square wave or hexagonal wave. The steep sloped contact areas provide good resistance to delamination. Alternatively layers of conventional corrugation such as in a hex wave cross-section may be used to meet the DPF layers for face-to-face bonds. FIG. 52 shows a stripmap/conventional-corrugation-cross-section sequence before and after assembling the layers together. This sequence may also use the steep sloped wall contact area to inhibit de-bonding.

It is often desirable to have a fine-scaled cellular structure in a multi-laminate material to achieve a homogeneity with user properties such as accepting of nails or screws, a fairly smooth cut surface, and the ability to be glued in all orientations. The fine pattern may require multiple small diameter patterned rollers as described earlier. As the material advances from one patterned roller to the next, it may be desirable to have mechanical indexing into the folded sheet that assists in timing the pattern correctly in the next set of patterned rollers. This mechanical indexing is preferably accomplished with dentured belts or similar moving mechanisms that move with the folded pattern from one roller to the next. Other guides may also be used to limit the spring back of the folded sheet. In some cases the next roller pair may be self indexing.

The dentured belt may also be valuable in providing accurate timing in the case of laminating two structures together. For instance when the DPF core layers nest carefully to give specific glue regions between successive sheets, the continuously manufactured neighboring layers may be glued in precise position using these belts. Alternatively indexing rollers may accept two incoming sheets and apply pressure in the right locations to join the sheets. In some cases one may prefer to laminate sheet pairs of a standard corrugation of chosen cross section and a DPF by using pressure rollers or belts, and than laminate these pairs together to form the large multi-layer structure. In FIG. 52, this may be carried out by laminating one hex-wave corrugation to each strip map and then laminating the pairs together.

Once the multi-layer block is glued, post processes may be performed such as cutting, drilling, milling, mold pressing, and glue assembly with additional folded laminates or other objects. For instance in packaging, the corner blocks around a computer box could be cut or glued from folded laminate sheets, the core inside a chair back could be pressed or milled from folded laminate sheets, large boards could be cut and substituted for particle board applications in counters, shelving, etc. or used for ceiling tile, floor liners, shipping crates, palettes, and many other applications.

In the case where the activated manufacturing process for producing folded structures is employed, there is a hybrid method between the continuous process for multi-laminate sheets and the batch process for custom parts. One may use the ASF method to design a doubly curved part. The description of the method of producing surfaces with specific curvatures may be used in conjunction with the ASF method, to give the individual requirements for the specific laminates in the desired part. The part design is arranged to nest repeated in a continuous sheet. This pattern is "printed" in the first step of the activated manufacturing process. The parts flow through the stages of the activated manufacturing process, and may be either cut and separated before the activation stage or after. For rapid prototyping and small production runs, the printing could be done by computer and so that with very minimal retooling variously shaped multi-laminate parts may be produced.

In the manufacturing processes with pre-gathering and patterned rollers, in general and specifically for rollers less than five inches in diameter, it may be desirable to cool the rollers during high speed production. This may be achieved by using hollow rollers with a circulating coolant inside. It may be preferred to apply water, mist, or other coolant or lubricant directly to the roller. It may be preferred to apply water, mist, or other coolant or lubricant to the sheet prior to engaging the roller or directly at the engaging area. In some cases it may be preferred to use one or more of these methods for cooling the roller.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

What is claimed is:

1. A method for providing a mathematical representation of a folded sheet structure having a desired overall shape, the method comprising:

(a) selecting an aspect surface having an original shape having a plurality of facets with vertices of known coordinates;

(b) applying a shaping function to said aspect surface to calculate coordinates of the vertices of a shaped surface having a shape approximating the desired overall shape, said shaped surface being non-foldable;

(c) applying a floating method to adjust the calculated coordinates of the vertices of the shaped surface achieving calculated coordinates of the vertices of a floated surface, the floated surface being a mathematical zero-curvature surface that is foldable, or more foldable than the shaped surface; and (d) calculating a corresponding fold pattern on an unfolded sheet based on the floated surface, the fold pattern allowing the unfolded sheet to be folded into the desired overall shape.

2. The method of claim 1 further comprising applying the floating method reiteratively.

3. The method of claim 1 further comprising applying the floating method with constraints.

4. The method of claim 1 wherein the aspect surface is selected from the group consisting of a mesh, a polygonolization, a triangulation, a spline surface, and a patched function graph, and a combination thereof.

5. The method of claim 1 wherein the floating method is an aspect floating method.

6. The method of claim 1 wherein the folded sheet structure comprises nano structures.

7. The method of claim 6, wherein the nano structures are prepared in conjunction with self assembly techniques.

8. The method of claim 1 further comprising:

impregnating the unfolded sheet with an agent to harden the unfolded sheet;

folding the sheet in accordance with the calculated fold pattern; and causing the agent to harden while the sheet is folded in accordance with the calculated fold pattern.

9. The method of claim 1 further comprising folding an unfolded sheet in accordance with the calculated fold pattern.

* * * * *